US007852001B2

(12) United States Patent
Ryu et al.

(10) Patent No.: US 7,852,001 B2
(45) Date of Patent: Dec. 14, 2010

(54) PLASMA DISPLAY APPARATUS

(75) Inventors: Seong Nam Ryu, Busan-si (KR); Woo Gon Jeon, Gumi-si (KR); Sang Min Hong, Gumi-si (KR); Woo Tae Kim, Yongin-si (KR); Kyung A Kang, Busan-si (KR); Jeong Hyun Hahm, Seoul (KR); Jae Sung Kim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 917 days.

(21) Appl. No.: 11/723,889

(22) Filed: Mar. 22, 2007

(65) Prior Publication Data

US 2007/0279321 A1 Dec. 6, 2007

(30) Foreign Application Priority Data

May 30, 2006 (KR) ..... 10-2006-0048821

(51) Int. Cl.
*H01J 17/49* (2006.01)

(52) U.S. Cl. ..... 313/582; 313/586

(58) Field of Classification Search ..... 313/581–587; 345/41

See application file for complete search history.

(56) References Cited

U.S. PATENT DOCUMENTS

| | | | | |
|---|---|---|---|---|
| 6,531,819 | B1 * | 3/2003 | Nakahara et al. | 313/584 |
| 6,534,915 | B2 | 3/2003 | Amemiya | 313/586 |
| 2002/0003515 | A1 * | 1/2002 | Lee et al. | 345/60 |
| 2002/0015012 | A1 | 2/2002 | Nakamura | 345/60 |
| 2003/0146713 | A1 | 8/2003 | Nagao et al. | 315/169.4 |
| 2005/0017636 | A1 | 1/2005 | Lin et al. | 313/582 |
| 2006/0071596 | A1 * | 4/2006 | Joo et al. | 313/586 |

FOREIGN PATENT DOCUMENTS

| | | | |
|---|---|---|---|
| CN | 1471721 | A | 1/2004 |
| EP | 1 308 982 | A2 | 5/2003 |
| EP | 1 406 288 | A2 | 4/2004 |
| EP | 1 507 277 | A1 | 2/2005 |

OTHER PUBLICATIONS

European Search Report dated Nov. 2, 2007.
European Search Report dated Feb. 15, 2008.
Chinese Office Action dated Jun. 19, 2009.

* cited by examiner

*Primary Examiner*—Joseph L Williams
*Assistant Examiner*—Brenitra M Lee
(74) *Attorney, Agent, or Firm*—Ked & Associates LLP

(57) ABSTRACT

A plasma display apparatus is provided. The plasma display apparatus including an upper substrate; a plurality of first electrodes and second electrodes formed in the upper substrate; a lower substrate arranged to be opposite to the upper substrate; and a plurality of third electrodes and barrier ribs formed in the lower substrate includes a black matrix formed in the upper substrate to be overlapped with the barrier ribs; and a fourth electrode formed on the black matrix to intersect the third electrodes, wherein at least one of the plurality of first and second electrodes is formed in one layer.

25 Claims, 17 Drawing Sheets

PLASMA DISPLAY APPARATUS

This nonprovisional application claims priority under 35 U.S.C. §119(a) on Patent Application No. 10-2006-0048821 filed in Korea on May 30, 2006 the entire contents of which are hereby incorporated by reference.

BACKGROUND OF THE INVENTION

1. Field of the Invention

The present invention relates to a plasma display apparatus, and more particularly, to a panel provided in a plasma display apparatus.

2. Description of the Conventional Art

In a plasma display panel, a barrier rib formed between an upper substrate and a lower substrate constitute one unit cell, and an inert gas containing a main discharge gas such as neon (Ne), helium (He), or a mixed gas (Ne+He) of neon and helium and a small amount of xenon is charged within each cell. When a discharge is generated by a high frequency voltage, an inert gas generates vacuum ultraviolet rays and allows a phosphor formed between barrier ribs to emit light, thereby embodying an image. Because such a plasma display panel is formed to be thin and light, it has been spotlighted as a future generation display device.

FIG. 1 is a perspective view illustrating a structure of a general plasma display panel.

As shown in FIG. 1, in the plasma display panel, an upper panel 100 and a lower panel 110 are arranged parallel to each other and apart a predetermined distance. The upper panel 100 is arranged with a plurality of sustain electrode pairs in which a scan electrode 102 and a sustain electrode 103 are formed in pairs on an upper substrate 101, which is a display surface in which an image is displayed, and the lower panel 110 is arranged with a plurality of address electrodes 113 to intersect the plurality of sustain electrode pairs on a lower substrate 111 constituting a rear surface.

The upper panel 100 is formed in pairs of the scan electrode 102 and the sustain electrode 103 having transparent electrodes 102*a* and 103*a* made of transparent Indium Tin Oxide (ITO) and bus electrodes 102*b* and 103*b*. The scan electrode 102 and the sustain electrode 103 are covered with an upper dielectric layer 104, and a protective layer 105 is formed on the upper dielectric layer 104.

The lower panel 110 includes barrier ribs 112 for partitioning discharge cells. Further, the plurality of address electrodes 113 is arranged parallel to the barrier ribs 112. R (Red), G (Green), B (Blue) phosphors 114 are coated on the address electrode 113. A lower dielectric layer 115 is formed between the address electrode 113 and the phosphor 114.

The transparent electrodes 102*a* and 103*a* constituting a conventional scan electrode 102 or sustain electrode 103 of the plasma display panel are made of expensive ITO. The transparent electrodes 102*a* and 103*a* increase a production cost of a plasma display panel. Accordingly, recently, a plasma display panel that can provide satisfactory visible characteristics and driving characteristics to a user while decreasing a production cost is required.

SUMMARY OF THE INVENTION

The present invention has been made in an effort to solve the above problems, and one embodiment of the present invention is directed to provide a plasma display apparatus that can reduce a production cost of a panel and improve flicker and luminescent spot generation of a display image by removing a transparent electrode made of ITO in the panel provided in the plasma display apparatus.

According to an aspect of the present invention, there is provided a plasma display apparatus including an upper substrate; a plurality of first electrodes and second electrodes formed in the upper substrate; a lower substrate arranged to be opposite to the upper substrate; and a plurality of third electrodes and barrier ribs formed in the lower substrate, including: a black matrix formed in the upper substrate to be overlapped with the barrier ribs; and a fourth electrode formed on the black matrix to intersect the third electrodes, wherein at least one of the plurality of first and second electrodes is formed in one layer.

According to another aspect of the present invention, there is provided a plasma display apparatus including an upper substrate; a plurality of first electrodes and second electrodes formed in the upper substrate; a lower substrate arranged to be opposite to the upper substrate; and a plurality of third electrodes and barrier ribs formed in the lower substrate, including: a black matrix formed in the upper substrate to be overlapped with the barrier ribs; a fourth electrode formed on the black matrix to intersect the third electrode; a line unit formed to intersect the third electrode; and a protruded unit protruded from the line unit, wherein at least one of the plurality of first and second electrodes is formed in one layer.

BRIEF DESCRIPTION OF THE DRAWING

The embodiment of the invention will be described in detail with reference to the following drawings in which like numerals refer to like elements.

DETAILED DESCRIPTION OF THE PREFERRED EMBODIMENT

Hereinafter, a plasma display apparatus according to the present invention will be described in detail with reference to the attached drawings.

Figure 2:
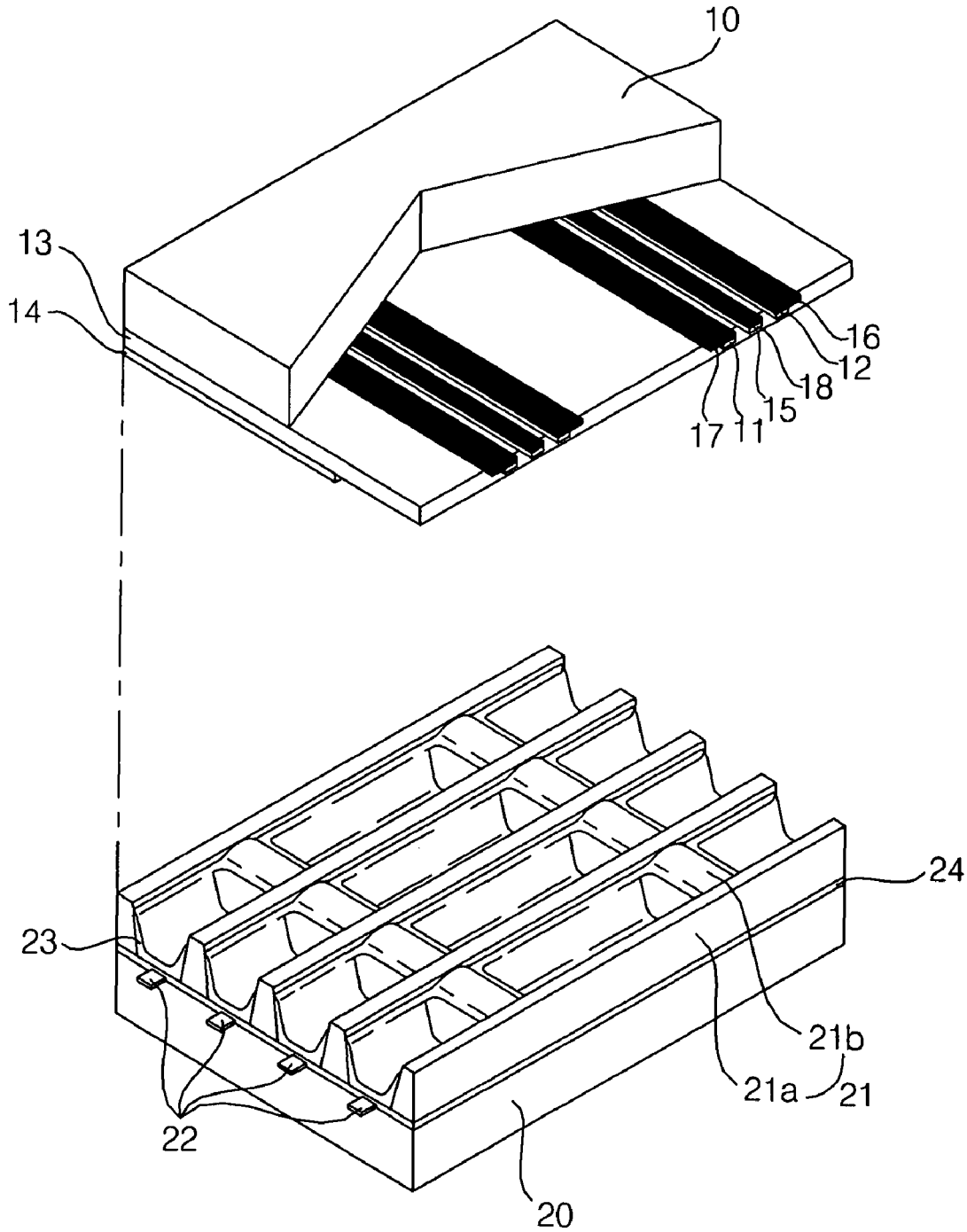
FIG. 2 is a perspective view illustrating an exemplary embodiment of a plasma display panel structure according to the present invention.

FIG. 2 is a perspective view illustrating an exemplary embodiment of a panel structure provided in a plasma display apparatus according to the present invention.

As shown in FIG. 2, the plasma display panel includes a scan electrode 11 and a sustain electrode 12, which is a sustain electrode pair formed on an upper substrate 10 and an address electrode 22 formed on a lower substrate 20.

Figure 1:
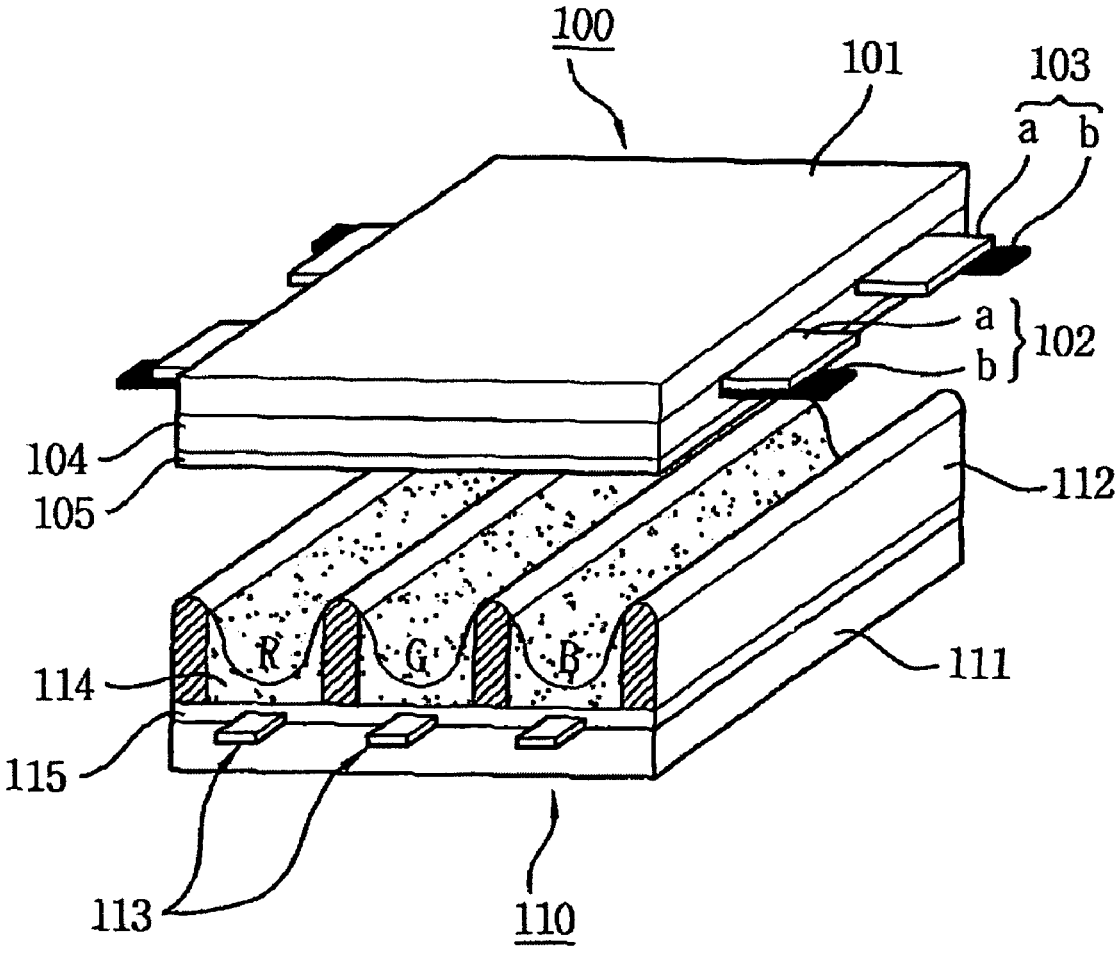
Fig.1 (related art)
FIG. 1 is a perspective view illustrating a structure of a general panel provided in a plasma display apparatus.

In the plasma display panel according to the present invention, the sustain electrode pair 11 and 12 is composed of only an opaque metal electrode, unlike a conventional sustain electrode pair shown in FIG. 1. A sustain electrode pair 11 and 12 is formed using silver (Ag), copper (Cu), or chrome (Cr), which is a material of conventional bus electrode without using ITO, which is a material of a conventional transparent electrode. Accordingly, a production cost of the plasma display panel can be lowered. That is, it is preferable that each of the sustain electrode pair 11 and 12 of the plasma display panel according to the present invention includes one layer consisting of only a bus electrode excluding a conventional ITO electrode.

For example, it is preferable that each of the sustain electrodes 11 and 12 according to an exemplary embodiment of the present invention is made of silver, and the silver has a property of photosensitivity. Further, each of the sustain electrode pair 11 and 12 according to an exemplary embodiment of the present invention has a color darker than an upper dielectric layer 13 formed in the upper substrate 10 and has lower light transmittance and high absorbance.

The upper dielectric layer 13 and a protective film 14 are stacked in the upper substrate 10 in which the scan electrode 11 and the sustain electrode 12 are formed in parallel to each other. Charged particles in which a discharge ionization gas (plasma) is generated are stacked in the upper dielectric layer 13. The protective film 14 protects the upper dielectric layer 13 from sputtering of charged particles generated at a gas discharge and increases emission efficiency of secondary electron. Further, magnesium oxide (MgO) is generally used in the protective film 14.

The address electrode 22 is formed to intersect the scan electrode 11 and the sustain electrode 12. Further, a lower dielectric layer 24 and a barrier rib 21 are formed on the lower substrate 20 in which the address electrode 22 is formed.

A phosphor layer 23 is formed on the surface of the lower dielectric layer 24 and the barrier rib 21. In the barrier rib 21, a vertical barrier rib 21*a* and a horizontal barrier rib 21*b* are formed in a closed type, and the barrier rib 21 physically partitions a discharge cell, thereby preventing ultraviolet rays and visible light generated by a discharge from being leaked to an adjacent discharge cell.

The phosphor layer 23 emits light by ultraviolet rays generated at a gas discharge and emits any one of red (R), green (G), or blue (B) visible light. An inert mixed gas such as He+Xe, Ne+Xe, and He+Ne+Xe for a discharge is injected in a discharge space provided between the upper/lower substrate 10 and 20 and the barrier rib 21.

The discharge cell may have a symmetrical structure in which a pitch of each of the R, G, and B phosphor layers 23 is equal or an asymmetrical structure in which a pitch thereof is different.

Each of the R, G, and B phosphor layers 23 may have a substantially equal width or different width. When a width of the phosphor layers 23 is different from each other in each of the R, G, and B discharge cells, a width of the phosphor layer 23 in the G or B discharge cell can be thicker than that of the phosphor layer 23 in the R discharge cell.

Further, black matrixes (BM) 15, 16, and 17 for performing a light intercepting function for reducing reflection and a function of improving purity and contrast of the upper substrate 10 by absorbing external light generated from the outside are arranged on the upper substrate 10.

The first black matrix 15 is formed in a position overlapped with the horizontal barrier rib 21*b* formed in the lower substrate 20 and the second black matrixes 16 and 17 are formed between the upper substrate 10 and the sustain electrodes 11 and 12. As shown in FIG. 2, the black matrix can have a separated structure separated from the first and second black matrixes 15, 16, and 17 or may have an integral structure different from a structure shown in FIG. 2.

In a forming process, the black matrix may be physically connected to the black layer by being formed with a black layer at the same time point and may not be physically connected to the black layer by being formed with a black layer at the different time point. Further, when the black matrix and the black layer are formed to be physically connected to each other, the black matrix and the black layer are made of the same material, but when the black matrix and the black layer are formed to be physically separated from each other, the black matrix and the black layer are made of a different material.

Further, a barrier rib structure of the panel shown in FIG. 2 shows a close type in which a discharge cell has a closed structure by the vertical barrier rib 21*a* and the horizontal barrier rib 21*b*, but may have a stripe type including only a vertical barrier rib and a fish-bone structure in which a projecting part is formed on a vertical barrier rib with a predetermined interval.

Further, an exemplary embodiment of the present invention may have a barrier rib structure having various shapes as well as a barrier rib structure shown in FIG. 2. For example, an exemplary embodiment of the present invention may have a differential barrier rib structure in which the vertical barrier rib 21*a* and the horizontal barrier rib 21*b* have a different height, a channel type barrier rib structure in which a channel that can be used as an exhaust passageway in at least one of the vertical barrier rib 21*a* and the horizontal barrier rib 21*b* is formed, and a hollow type barrier rib structure in which a hollow is formed in at least one of the vertical barrier rib 21*a* and the horizontal barrier rib 21*b*. In the differential barrier rib structure, it is preferable that a height of the horizontal barrier rib 21*b* is higher than that of the vertical barrier rib 21*a*, and in the channel type barrier rib structure and the hollow type barrier rib structure, it is preferable that a channel or a hollow is formed in the horizontal barrier rib 21*b*.

In an exemplary embodiment of the present invention, the R, G, and B discharge cells are arranged in the same line, but may be arranged in a different shape. For example, the R, G, and B discharge cells may have delta shape arrangement in which they are arranged in a triangle shape. Further, the discharge cells may have various polygonal shapes such as a quadrangle, a pentagon, and a hexagon.

Further, a pitch of the vertical barrier rib 21*a* and that of the horizontal barrier rib 21*b* may be different, and the width of the barrier rib may be a wide width or a narrow width. Further, it is preferable that a width of the horizontal barrier rib 21*b* is 1.0 to 5.0 times than that of the vertical barrier rib 21*a*.

A pitch of the R, G, and B discharge cells in a plasma display panel according to an exemplary embodiment of the present invention may be substantially equal and may be different in order to adjust a color temperature in the R, G, and B discharge cells. In this case, entire pitches may be different in each of the R, G, and B discharge cells, but only a pitch of the discharge cell that expresses one color of the R, G, and B discharge cells may be different. For example, a pitch of the R discharge cell is smallest, and a pitch of the G and B discharge cells may be larger than that of the R discharge cell.

Further, the address electrode formed on the lower substrate 20 may have substantially the same pitch or width, but a pitch or a width within the discharge cell may be different from that outside the discharge cell. For example, a pitch or a width within the discharge cell may be wider or thicker than that outside the discharge cell.

It is preferable that a material of the barrier rib 21 does not use lead (Pb) or includes 0.1 wt % of a total weight of a plasma display panel or 1000 PPM (Parts Per Million) or less even though the material of the barrier rib 21 uses lead.

When a total content of a lead component is 1000 PPM or less, a content of lead to a weight of the plasma display panel becomes 1000 PPM or less.

Otherwise, a content of a lead component in a specific element of the plasma display panel may become 1000 PPM or less. For example, a content of a lead component of a barrier rib, a lead component of a dielectric layer, or a lead component in an electrode may become 1000 PPM or less to a weight of each component (a barrier rib, a dielectric layer, and an electrode).

Further, each content of a lead component of entire elements such as a barrier rib, a dielectric layer, an electrode, and a phosphor layer of a plasma display panel may become 1000 PPM or less to a weight of the plasma display panel. The reason why an entire content of a lead component is set to 1000 PPM or less is that the lead component has a bad influence on a human body.

As shown in FIG. 2, in a plasma display panel according to an exemplary embodiment of the present invention, it is preferable that a floating electrode 18 is formed to be contacted with the first black matrix 15.

If a voltage higher than a predetermined voltage is supplied between the floating electrode 18 and the sustain electrodes 11 and 12 adjacent to the floating electrode 18, a discharge is generated between the two electrodes. By a discharge using the floating electrode 18, electric charges are stacked in the sustain electrodes 11 and 12 adjacent to the floating electrode 18, so that a discharge of the sustain electrodes 11 and 12 is facilitated.

Because an ITO transparent electrode does not exist in a plasma display panel according to the present invention, it is preferable that an interval between the sustain electrode Z and the scan electrode Y constituting one discharge cell is long in order to compensate the decrease of brightness due to non-existence of the ITO transparent electrode. When an interval between the sustain electrode Z and the scan electrode Y is lengthened, an initial discharge firing voltage increases between the two electrodes.

Accordingly, electric charges are stacked by generating a discharge between the floating electrode 18 and the sustain electrode Z and the scan electrode Y adjacent thereto before generating a sustain discharge between the sustain electrode Z and the scan electrode, whereby a discharge firing voltage for generating a sustain discharge between the sustain electrode Z and the scan electrode Y can be decreased.

It is preferable that the floating electrode 18 is formed to be overlapped with the horizontal barrier rib 21*b*. Further, it is preferable that a width of the floating electrode 18 is smaller than that of the first black matrix 15 and a difference in a width of the floating electrode 18 and the first black matrix 15 is 10 to 20 μm.

The floating electrode 18 may be floated or grounded in order to prevent a cross-talk between electrodes. Further, the floating electrode 18 may be positioned at the center of the discharge cell.

The structure shown in FIG. 2 is an exemplary embodiment of a structure of a plasma display panel according to the present invention and the present invention is not limited to a structure of the plasma display panel shown in FIG. 2. For example, in FIG. 2, one floating electrode 18 is formed on the first black matrix 15, but two or more floating electrodes may be formed on the first black matrix 15.

Figure 3A:
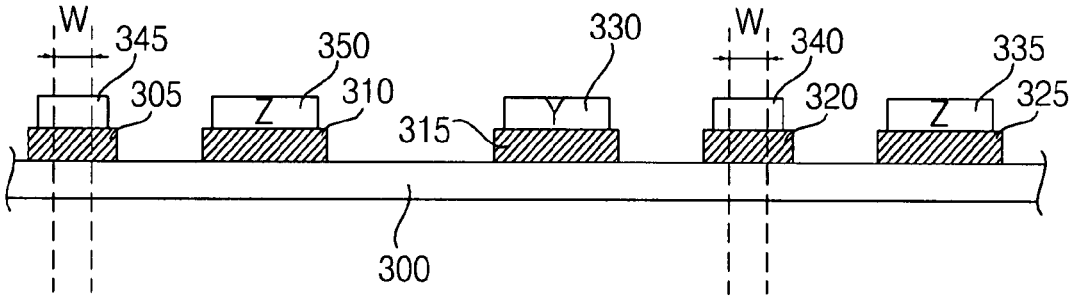
FIGS. 3*a* to 3*c* are cross-sectional views schematically illustrating exemplary embodiments of an upper panel structure of a plasma display panel according to the present invention.
Figure 3B:
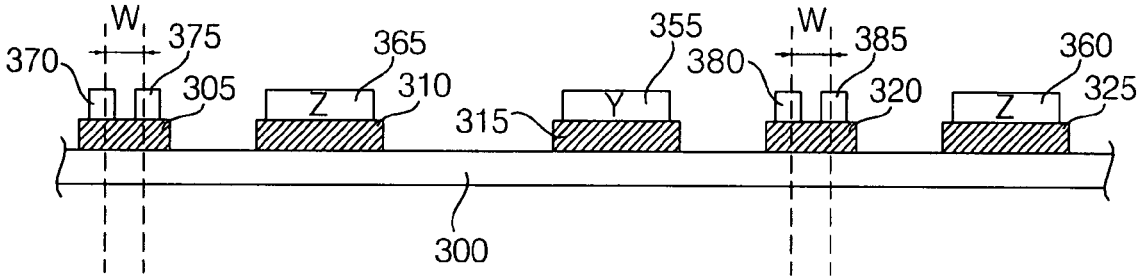
Figure 3C:
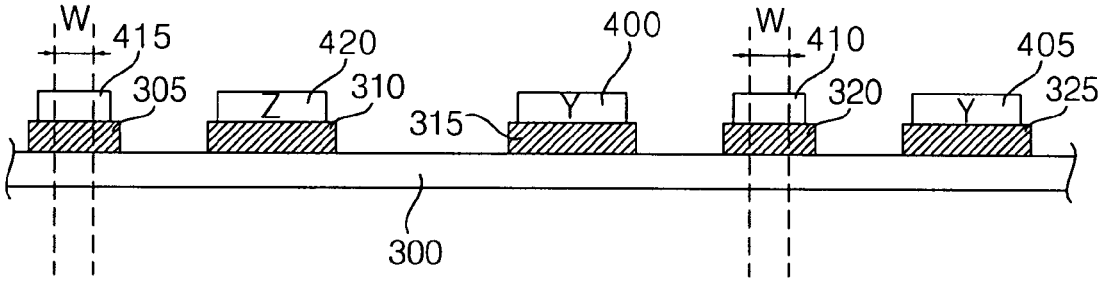

FIGS. 3*a* to 3*c* are cross-sectional views schematically illustrating exemplary embodiments of an upper panel structure of a plasma display panel according to the present invention.

As shown in FIG. 3*a*, the first black matrixes 305 and 320 and the second black matrixes 310, 315, and 325 are formed on the upper substrate 300. Floating electrodes 340 and 345 are formed on the first black matrixes 305 and 320, respectively to be overlapped with a horizontal barrier rib (not shown), and the scan electrode Y or the sustain electrode Z formed in one layer is formed on the second black matrixes 310, 315, and 325.

It is preferable that a pitch of the floating electrodes 340 and 345 is smaller than that of the first black matrixes 305 and 320. It is preferable that a pitch of the floating electrodes 340 and 345 is smaller by 10 or 20 μm than that of the first black matrixes 305 and 320 and by absorbing external light generated from the outside due to a difference in the width, transmittance can be reduced and contrast of an image can be improved.

If a voltage higher than a predetermined voltage is supplied between the floating electrode 340 and the scan electrode (Y) 330, a discharge is generated between two electrodes 330 and 340 and thus electric charges are stacked in the scan electrode (Y) 330. A discharge firing voltage between the scan electrode (Y) 330 and the sustain electrode 350 decreases by the stacked electric charges.

In the description, a discharge generated between the floating electrode 340 and the scan electrode (Y) 330 is exemplified, but a discharge may be generated by supplying a voltage higher than a predetermined voltage between the floating electrode 340 and the sustain electrode (Z) 335.

It is preferable that a distance between the floating electrodes 340 and 345 and the scan electrode 330 or the sustain electrodes (Z) 335 and 350 is 30 to 60 μm and in this case, an initial discharge is stably generated between the floating electrodes 340 and 345 and the sustain electrodes 330, 335, and 350, whereby electric charges can be stacked in the sustain electrodes 330, 335, and 350.

A method of forming the black matrixes 305, 310, 315, 320, and 325, the sustain electrodes (Z) 350 and 325, the scan electrode (Y) 330, and the floating electrodes 340 and 345 having a structure shown in FIG. 3*a* on the upper substrate 300 is as follows. First, after a black matrix layer is printed on the upper substrate 300 and a metal electrode layer such as Ag is printed, the black matrix layer and the metal electrode layer are absorbed on the upper substrate 300 through exposing. By such a method, the number of times of exposing can be reduced from two times to one time.

FIG. 3*b* illustrates a case in which two floating electrodes 370, 375, 380, and 385 are formed in each of the first black matrixes 305 and 320 on the upper substrate 300, and descriptions described in FIG. 3*a* will be omitted.

As shown in FIG. 3*b*, it is preferable that two floating electrodes 370, 375, 380, and 385 formed in each of the first black matrixes 305 and 320 are overlapped with a horizontal barrier rib (not shown). Further, as described above, the number of floating electrodes formed in each of the first black matrixes 305 and 320 may be three or more.

It is preferable that a distance between the floating electrodes 370, 375, 355, 385 and sustain electrodes 365, 355, and 360 adjacent thereto is 30 to 60 μm and in this case, an initial discharge between the floating electrodes 370, 375, 355, and 385 and the sustain electrode 365, 355, and 360 adjacent thereto is stably generated, whereby electric charges can be stacked in the sustain electrodes 365, 355, and 360.

As shown in FIG. 3*c*, a plasma display panel according to the present invention may have an YZZY structure in which an electrode is arranged in order of a scan electrode Y, a sustain electrode Z, the sustain electrode Z, and the scan electrode Y. In this case, floating electrodes 410 and 415 can be positioned between the scan electrode Y and the scan electrode Y or the sustain electrode Z and the sustain electrode Z.

Figure 4:
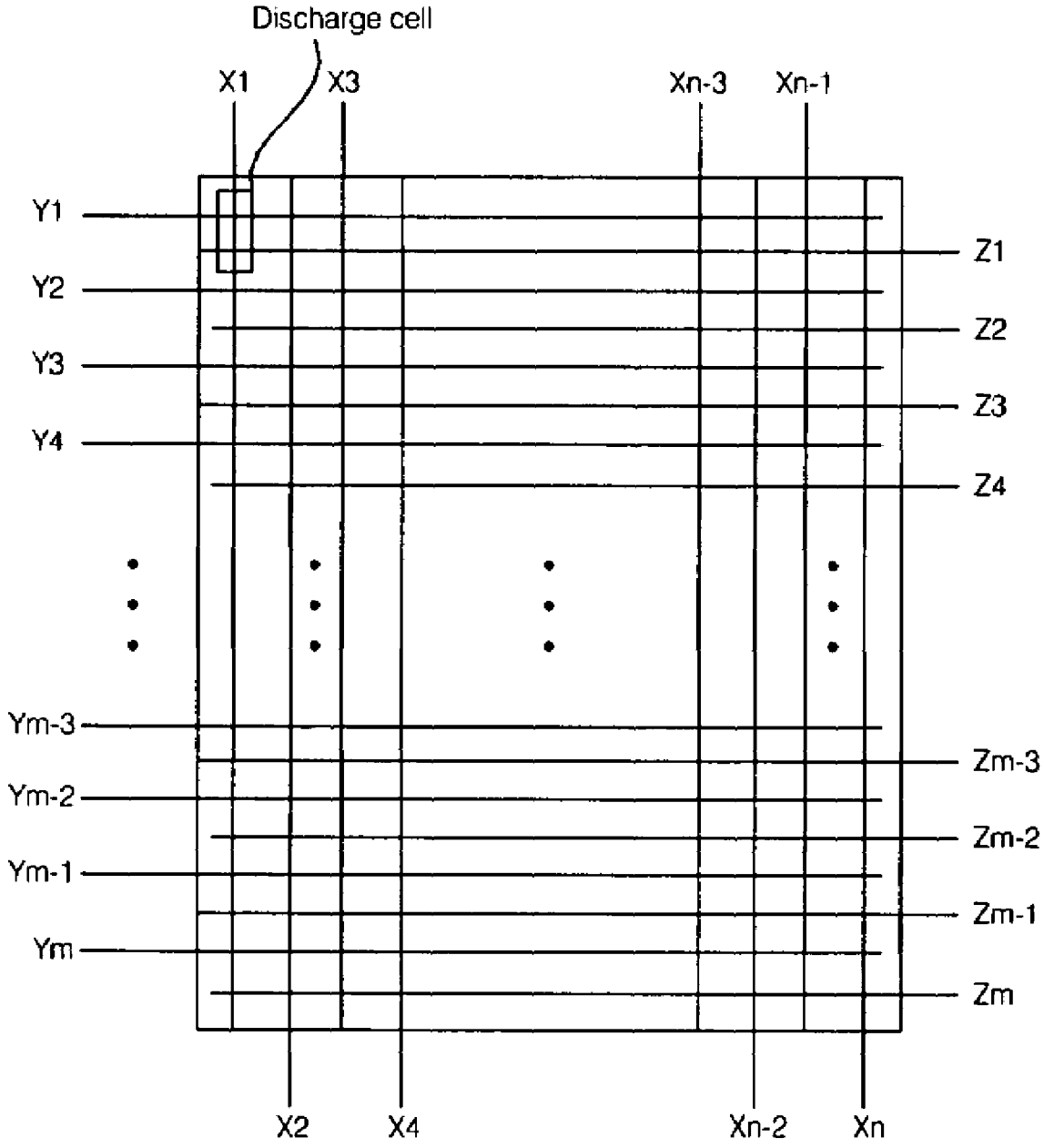
FIG. 4 is a cross-sectional view illustrating an exemplary embodiment of electrode arrangement of a plasma display panel according to the present invention.

FIG. 4 is a cross-sectional view illustrating an exemplary embodiment of electrode arrangement of a plasma display panel according to the present invention. It is preferable that as shown in FIG. 4, a plurality of discharge cells constituting the plasma display panel is arranged in a matrix form. Each of the plurality of discharge cells is provided in a crossing region of scan electrode lines Y1 to Ym, sustain electrode lines Z1 to Zm, and address electrode lines X1 to Xn. The scan electrode lines Y1 to Ym are sequentially driven and the sustain electrode lines Z1 to Zm are commonly driven. The address electrode lines X1 to Xn are divided into even-numbered lines and odd-numbered lines for driving.

The electrode arrangement shown in FIG. 4 is an exemplary embodiment for electrode arrangement of a plasma display panel according to the present invention and the present invention is not limited to electrode arrangement and driving method of the plasma display panel shown in FIG. 4. For example, the present invention can be driven even with a dual scan or double scan method in which two scan electrode lines of the scan electrode lines (Y1 to Ym) are simultaneously driven. The dual scan method is a method of dividing a plasma display panel into two regions of an upper region and a lower region and simultaneously driving each scan electrode belonging to each of the upper region and the lower region. Further, the double scan method is a method of simultaneously driving two scan electrode lines continuously arranged.

In FIG. 4, the address electrodes are divided into even-numbered electrode lines and odd-numbered electrode lines for driving, but the address electrodes may be simultaneously driven without being divided. In this case, as shown in FIG. 4, the address electrode driver is arranged in not both of an upper part and a lower part of the panel but only one of an upper part and a lower part thereof.

Figure 5:
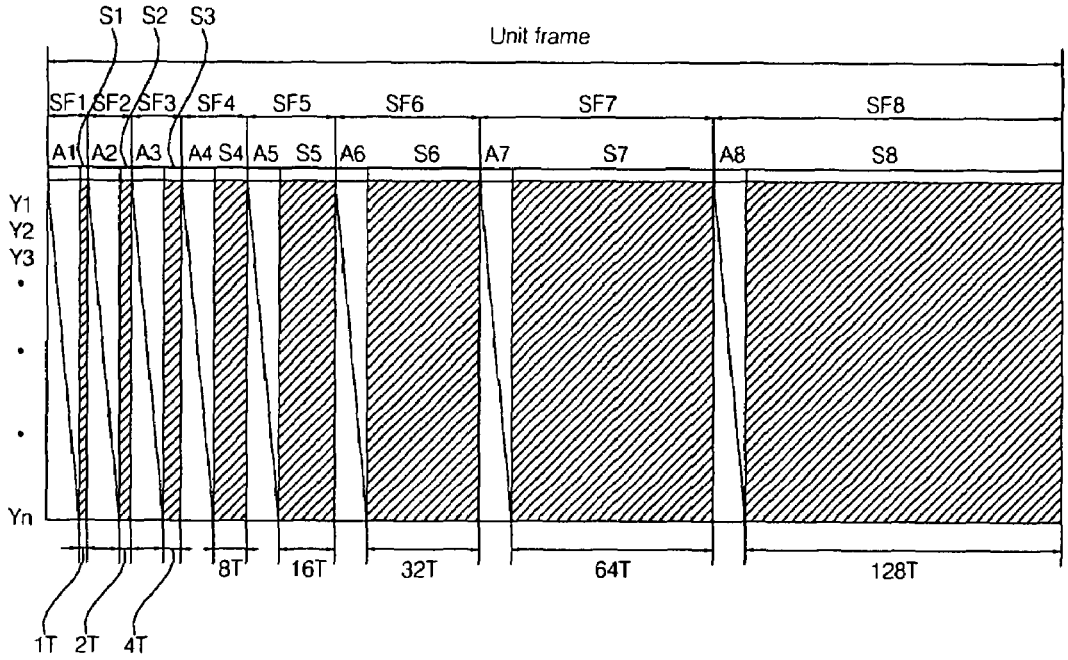
FIG. 5 is a timing chart illustrating an exemplary embodiment of a method of dividing one frame into a plurality of subfields and driving a plasma display panel in a time division manner.

FIG. 5 is a timing chart illustrating an exemplary embodiment of a method of dividing one frame into a plurality of subfields and driving the frame in a time division manner in the plasma display panel according to the present invention having the described structure.

In order to represent a time division gray scale display, a unit frame can be divided into a predetermined number, e.g. 8 subfields SF1 to SF8. Further, each of the subfields SF1 to SF8 is divided into a reset period (not shown), an address period A1 to A8, and a sustain period S1 to S8.

In each of the address periods A1 to A8, a display data signal is supplied to the address electrode X and the corresponding scan pulses are sequentially supplied to each scan electrode Y.

In each of the sustain periods S1 to S8, sustain pulses are alternately supplied to the scan electrode Y and the sustain electrode Z, and in the address periods A1 to A8, a sustain discharge is generated in discharge cells in which wall electric charges are formed.

Brightness of the plasma display panel is in proportional to the number of sustain discharge pulses within sustain discharge periods S1 to S8 that occupy a unit frame. When one frame constituting one image is expressed with 8 subfields and 256 gray scales, the number of different sustain pulses can be allocated in each subfield with a ratio of 1, 2, 4, 8, 16, 32, 64, and 128 in order. In order to obtain brightness having 133 gray scales, a sustain discharge is performed by addressing cells during a subfield 1 period, a subfield 3 period, and a subfield 8 period.

The number of sustain discharges allocated to each subfield can be variably determined by a weight of subfields according to a step of Automatic Power Control (APC). That is, in FIG. 5, a case in which one frame is divided into 8 subfields is exemplified, but the present invention is not limited thereto and the number of subfields constituting one frame can be variously changed according to a design specification. For example, a plasma display panel can be driven by dividing one frame into 8 subfields or more or 8 subfields or less as in 12 or 16 subfields.

Further, in view of gamma characteristics or panel characteristics, the number of sustain discharges allocated to each subfield can be variously changed. For example, a gray scale level allocated to subfield 4 can be decreased from 8 to 6 and a gray scale level allocated to subfield 6 can be increased from 32 to 34.

Figure 6:
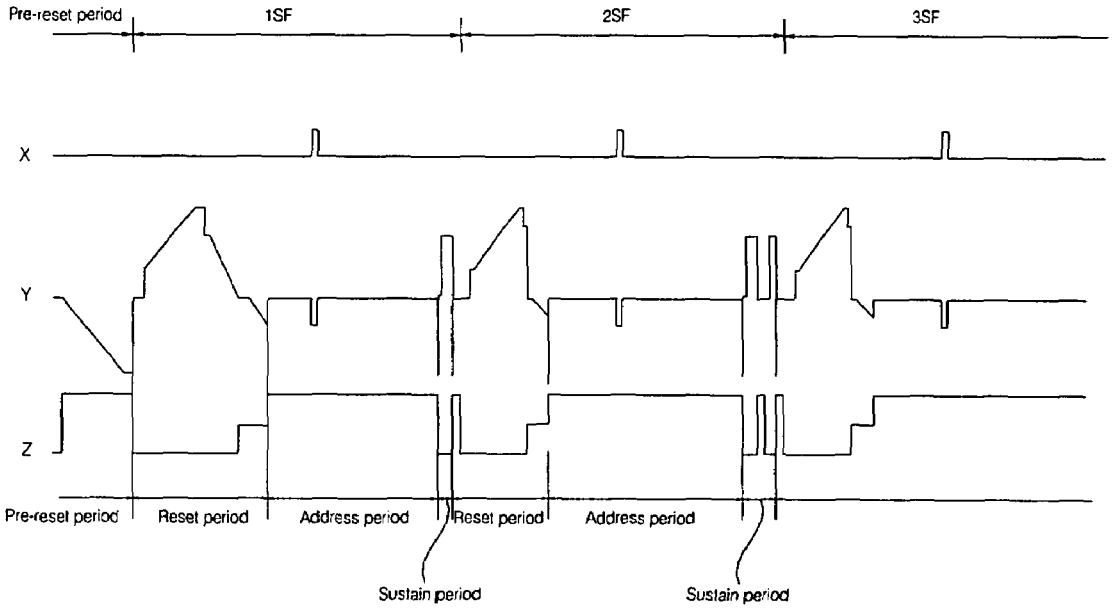
FIG. 6 a timing chart illustrating an exemplary embodiment of driving signals for driving a plasma display panel according to the present invention.

FIG. 6 is a timing chart illustrating an exemplary embodiment of driving signals for driving a plasma display panel according to the present invention having the described structure in the divided one subfield.

Referring to FIG. 6, a subfield SF is first divided into a reset period for initializing electric charges within a discharge cell, an address period for selecting a discharge cell in which an image is displayed or a discharge cell in which an image is not displayed, and a sustain period for displaying an image by generating a sustain discharge in a discharge cell to display a selected image in the address period, and the reset period is again divided into a setup period and a setdown period. In the setup period, by applying a gradually rising setup signal to the scan electrode Y, a setup discharge is generated within all discharge cells and thus wall charges are stacked, and in the setdown period, a feeble erase discharge is generated by applying a gradually falling setdown signal and thus wall charges to stably generate an address discharge are uniformly remained within a discharge cell.

Further, by providing a pre-reset period before a reset period, enough formation of wall charges is assisted, and by applying a waveform for gradually decreasing a voltage value of a scan electrode Y before a reset period and applying a positive voltage to a sustain electrode Z, a pre-reset discharge is generated. It is preferable that in view of a driving margin, the pre-reset period exists only in a first subfield SF1.

In an address period, scan signals are sequentially applied to each of the scan electrode Y and a positive data signal synchronizing with a scan signal applied to the scan electrode Y is applied to the address electrode X. As a wall voltage generated during a reset period is added to a voltage difference between the scan signal and the data signal, an address discharge is generated within a discharge cell and thus wall charges for a sustain discharge are formed.

In a sustain period, a sustain signal is alternately applied to the scan electrode Y and the sustain electrode Z and whenever each sustain signal is applied, a sustain discharge, that is, a display discharge is generated in a discharge cell selected by an address discharge.

Waveforms shown in FIG. 6 are an exemplary embodiment of signals for driving a plasma display panel according to the present invention and the present invention is not limited to waveforms shown in FIG. 6. For example, a reset period may be omitted in at least one of a plurality of subfields constituting one frame, the reset period may exist only in a first subfield, and a pre-reset period may be omitted.

A polarity and voltage level of driving signals shown in FIG. 6 can be changed as needed. After a sustain discharge is completed, an erase signal for erasing wall charges may be applied to the sustain electrode Z, and as a sustain signal is applied to only any one of the scan electrode Y and the sustain electrode Z, single sustain driving for generating a sustain discharge can be performed.

It is preferable that the sustain electrodes 202 and 203 within one discharge cell are formed in a plurality of electrode lines. That is, it is preferable that the first sustain electrode 202 is formed in two electrode lines 202*a* and 202*b*, and the second sustain electrode 203 is symmetrically arranged to the first sustain electrode 202 based on the center of the discharge cell and is formed in two electrode lines 203*a* and 203*b*. It is preferable that the first and second sustain electrodes 202 and 203 are a scan electrode and a sustain electrode, respectively. This is because an aperture ratio and discharge diffusion efficiency are considered by using an opaque sustain electrode pair 202 and 203. That is, in view of an aperture ratio, an electrode line having a narrow pitch is used, and in view of discharge diffusion efficiency, a plurality of electrode lines is used. It is preferable that in view of an aperture ratio and discharge diffusion efficiency at the same time, the number of electrode lines is determined.

It is preferable that each of the scan electrode 11 and the sustain electrode 12 shown in FIG. 2 is formed in a plurality of electrode lines. That is, it is preferable that the scan electrode 11 is formed in two electrode lines, the sustain electrode 12 is symmetrically arranged to the scan electrode 11 based on the center of the discharge cell and is formed in two electrode lines. This is because an aperture ratio and discharge diffusion efficiency is considered by using the opaque sustain electrode pair 11 and 12. That is, in view of an aperture ratio, an electrode line having a narrow width is used and in view of discharge diffusion efficiency, a plurality of electrode lines is used. It is preferable that in view of an aperture ratio and discharge diffusion efficiency at the same time, the number of electrode lines is determined.

Figure 7:
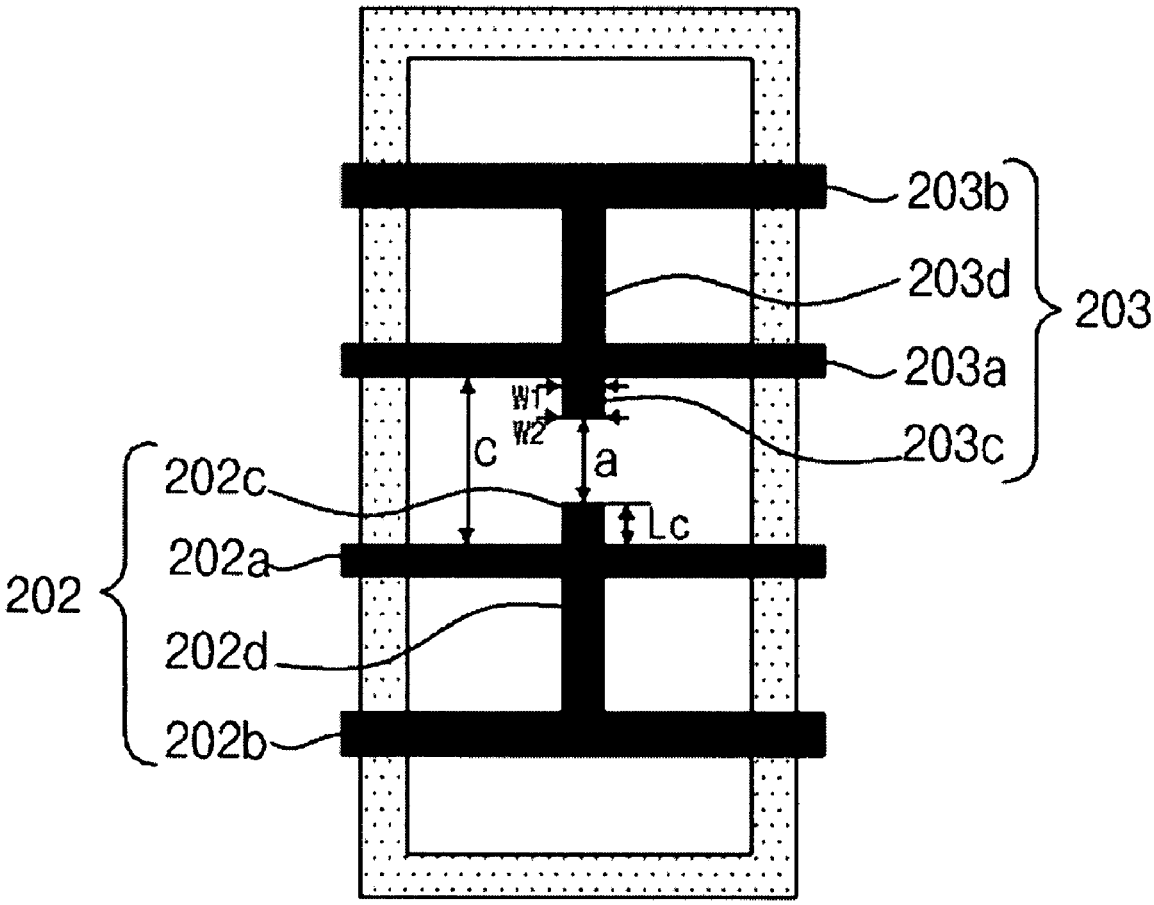
FIG. 7 is a cross-sectional view illustrating a first exemplary embodiment of an electrode structure of a plasma display panel according to the present invention.

FIG. 7 is a cross-sectional view illustrating a first exemplary embodiment of an electrode structure of a plasma display panel according to the present invention. In FIG. 7, an arrangement structure of a sustain electrode pair 202 and 203 is simply displayed within one discharge cell of the plasma display panel and arrangement of a black p matrix and a floating electrode is omitted.

As shown in FIG. 7, the sustain electrodes 202 and 203 according to the first embodiment of the present invention are formed in pairs to be symmetrical based on the center of a discharge cell on the substrate. Each of the sustain electrodes includes a line unit including at least two electrode lines 202*a* and 202*b*, 203*a*, and 203*b* intersecting the discharge cell, which is connected to the electrode line 202*a* and 203*a* nearest to the center of the discharge cell and a projection unit including at least one projection electrode 202*c* and 203*c* projected in the center direction of the discharge cell within the discharge cell. Further, as shown in FIG. 7, it is preferable that each of the sustain electrode further includes one bridge electrode 202*d* and 203*d* for connecting the two electrode lines.

The electrode lines 202*a* and 202*b*, 203*a*, and 203*b* intersect a discharge cell and are extended in one direction of a plasma display panel. The same driving pulse is supplied to a discharge cell positioned on the same electrode line. The electrode line according to the first embodiment of the present invention has a narrow width to improve an aperture ratio. Further, it is preferable that a plurality of electrode lines 202*a* and 202*b*, 203*a*, and 203*b* are used to improve discharge diffusion efficiency and in view of an aperture ratio, the number of the electrode lines is determined.

It is preferable that the projection electrodes 202*c* and 203*c* are connected to the electrode lines 202*a* and 203*a* nearest from the center of the discharge cell within one discharge cell and are projected in a center direction of the discharge cell. When a plasma display panel is driven, the projection electrodes 202*c* and 203*c* lower a discharge firing voltage. As the number of the electrode line increases, a distance between the electrode lines 202*a* and 203*a* adjacent to the center of the discharge cell is extended. As a distance between the electrode lines 202*a* and 203*a* is extended, a discharge firing voltage increases, so that the first embodiment of the present invention include the projection electrodes 202*c* and 203*c* connected to each of the electrode lines 202*a* and 203*a*. Because a discharge is started even in a low discharge firing voltage between nearly formed projection electrodes 202*c* and 203*c*, a discharge firing voltage of the plasma display panel can be lowered. Here, the discharge firing voltage is a voltage level in which a discharge is started when a pulse is supplied to at least one electrode of the sustain electrode pair 202 and 203.

Because such a projection electrode has a very small size, due to a positional difference in a production process, a width W1 of a part substantially connected to the electrode lines 202*a* and 203*a* of the projection electrodes 202*c* and 203*c* can be formed wider than a width W2 of the tip of the projection electrode. Further, a width of the tip can be widened as needed.

The bridge electrodes 202*d* and 203*d* are connected to the electrode lines of each sustain electrode. That is, the first bridge electrode 202*d* connects the electrode lines 202*a* and 202*b* of the first sustain electrode 202 to each other. The second bridge electrode 203*d* connects electrode lines 203*a* and 203*b* of the second sustain electrode 203 to each other. The bridge electrodes 202*d* and 203*d* assist a discharge started through a projection electrode to be easily diffused to the electrode lines 202*b* and 203*b* far from the center of a discharge cell.

In this way, an electrode structure according to the first embodiment of the present invention can improve an aperture ratio by adjusting the number of electrode lines. Further, a discharge firing voltage can be lowered by forming a projection electrode. Further, discharge diffusion efficiency can be increased by a bridge electrode and an electrode line far from the center of a discharge cell. Light emitting efficiency of a plasma display panel can be entirely improved. That is, because brightness of the plasma display panel can be equal to or brighter than that of a conventional plasma display panel, an ITO electrode cannot be used.

Figure 8:
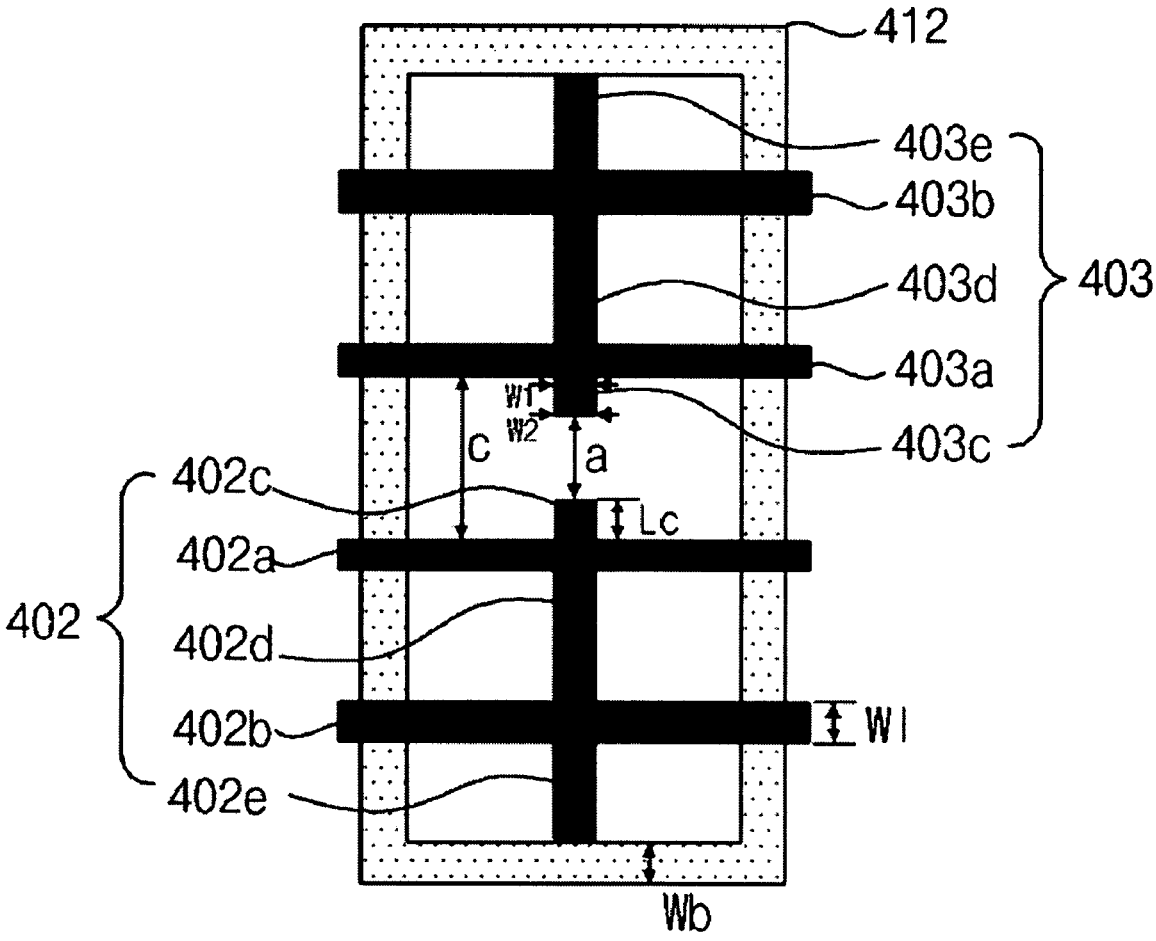
FIG. 8 is a cross-sectional view illustrating a second exemplary embodiment of an electrode structure of a plasma display panel according to the present invention.

FIG. 8 is a cross-sectional view illustrating a second exemplary embodiment of an electrode structure of a plasma display panel according to the present invention, where sustain electrodes 402 and 403 according to the second exemplary embodiment of the present invention are formed in pairs in one discharge cell on the substrate. Each of the sustain electrodes 402 and 403 includes one the first projection electrode 402*c* and 403*c* projecting in a center direction of a discharge cell within the discharge cell, which is connected to at least two electrode lines 402*a*, 402*b*, 403*a*, and 403*b* intersecting a discharge cell and the electrode lines 402*a* and 403*a* nearest to the center of the discharge cell, one bridge electrode 402*d* and 403*d* for connecting the two electrode lines, and second projection electrodes 402*e* and 403*e* projected in the center direction of the discharge cell within the discharge cell, which is connected to the electrode line 402*b* and 403*b* farthest from the center of a discharge cell.

The electrode lines 402*a*, 402*b*, 403*a*, and 403*b* intersect the discharge cell and are extended in one direction of a plasma display panel. The electrode line according to the second embodiment of the present invention has a narrow width in order to improve an aperture ratio. A width W1 of the electrode line has preferably 20 um to 70 um to improve an aperture ratio and smoothly generate a discharge.

As shown in FIG. 8, the electrode lines 402*a* and 403*a* near the center of a discharge cell are connected to the first projection electrodes 402*c* and 403*c*, and the electrode lines 402*a* and 403*a* near the center of the discharge cell form a path in which discharge diffusion is started at the same time with the start of a discharge. The electrode lines 402*b* and 403*b* far from the center of the discharge cell are connected to the second projection electrodes 402*e* and 403*e*. The electrode lines 402*b* and 403*b* far from the center of the discharge cell performs a function of diffusing a discharge to a surrounding part of the discharge cell.

The first projection electrodes 402*c* and 403*c* are connected to the electrode lines 402*a* and 403*a* near the center of the discharge cell within one discharge cell and are projected in a center direction of the discharge cell. Preferably, the first projection electrode is positioned at the center of the electrode lines 402*a* and 403*a*. The first projection electrodes 402*c* and 403*c* is positioned to the center of the electrode line to correspond to each other to more effectively lower a discharge firing voltage of a plasma display panel.

The bridge electrodes 402*d* and 403*d* connect electrode lines of each sustain electrode. The bridge electrodes 402*d* and 403*d* assist to easily diffuse a discharge started through the projection electrode to the electrode lines 402*b* and 403*b* far from the center of the discharge cell. Here, the bridge electrodes 402*d* and 403*d* are positioned within a discharge cell, but the bridge electrodes 402*d* and 403*d* may be formed on a barrier rib 412 for partitioning a discharge cell as needed.

The second projection electrodes 402*e* and 403*e* are connected to the electrode lines 402*b* and 403*b* far from the center of the discharge cell within one discharge cell and are projected in a direction opposite to a center direction of the discharge cell. Accordingly, in the second embodiment of an electrode structure of a plasma display panel according to the present invention, a discharge can be diffused to a space between the electrode lines 402*b* and 403*b* and the barrier rib 412. That is, light emitting efficiency of a plasma display panel can be improved by increasing discharge diffusion efficiency.

The second projection electrodes 402*e* and 403*e* can be extended to the barrier rib 412 for partitioning a discharge cell. Further, if an aperture ratio is fully compensated from another part, the second projection electrodes 402*e* and 403*e* can be partly extended on the barrier rib 412 in order to further improve discharge diffusion efficiency. In the second exemplary embodiment of the present invention, it is preferable to uniformly diffuse a discharge in a surrounding part of a discharge cell by positioning the second projection electrodes 402*e* and 403*e* at a mid point of the electrode lines 402*b* and 403*b*.

Figure 9:
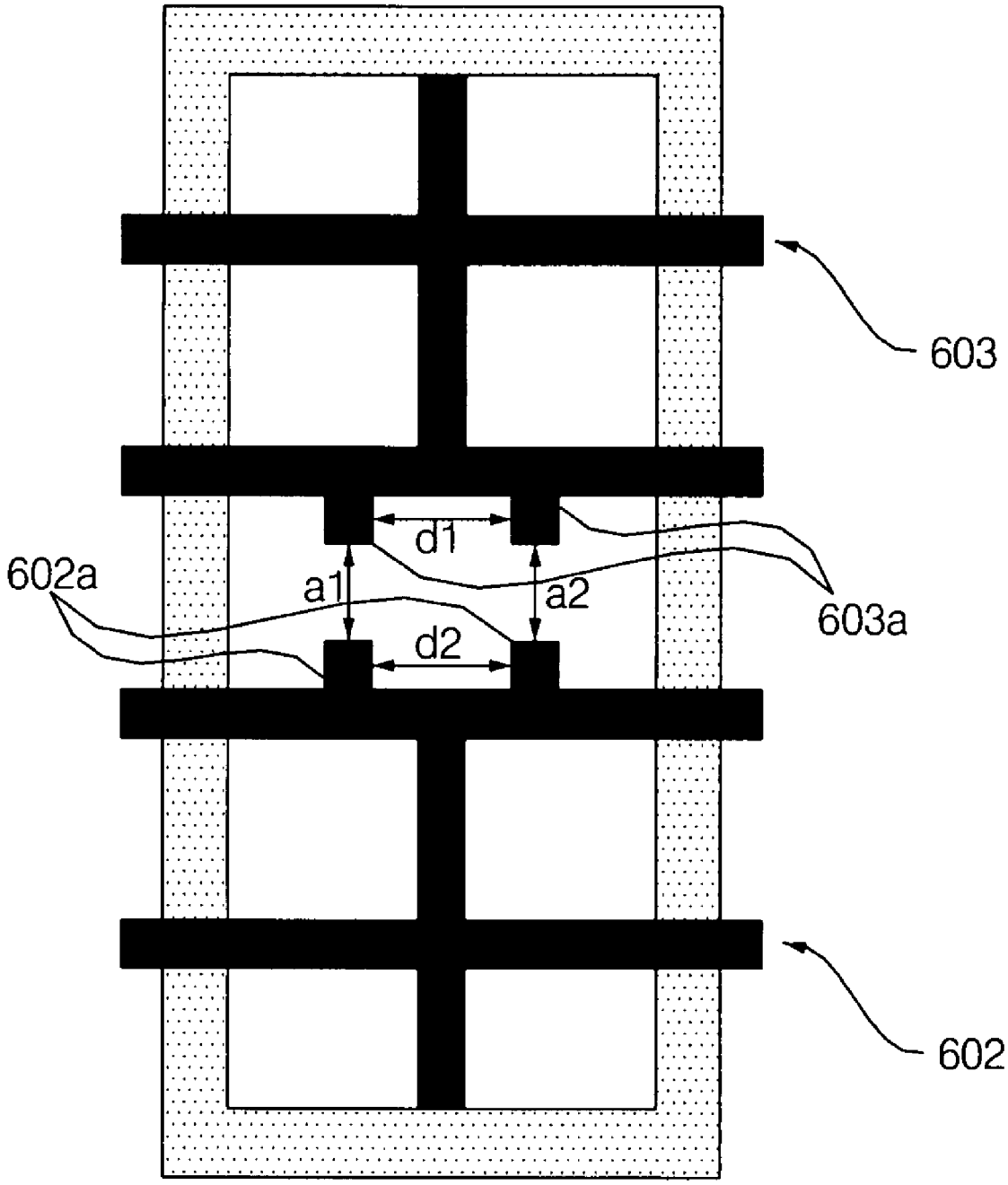
FIG. 9 is a cross-sectional view illustrating a third exemplary embodiment of an electrode structure of a plasma display panel according to the present invention.

FIG. 9 is a cross-sectional view illustrating a third exemplary embodiment of an electrode structure of a plasma display panel according to the present invention.

Descriptions described in FIG. 8 among electrode structures shown in FIG. 9 will be omitted.

As shown in FIG. 9, in the third embodiment of a sustain electrode structure according to the present invention, two first projection electrodes 602*c* and 603*c* are formed in each of sustain electrodes 602 and 603. The first projection electrodes 602*c* and 603*c* are connected to the electrode lines 402*a* and 403*a* near the center of the discharge cell within one discharge cell and are projected in a center direction of the discharge cell. It is preferable that each of the first projection electrode is formed to be symmetrical to each other based on a mid point of the electrode line.

An area of a sustain electrode in the center of a discharge cell is increased by forming two first projection electrodes in each of the sustain electrode. Accordingly, before a discharge starts, many space charges are formed within a discharge cell and thus a discharge firing voltage is further lowered and a discharge speed becomes fast. Further, after a discharge is started, a wall charge amount increases and thus brightness increases, whereby a discharge is uniformly diffused in an entire discharge cell.

Figure 10:
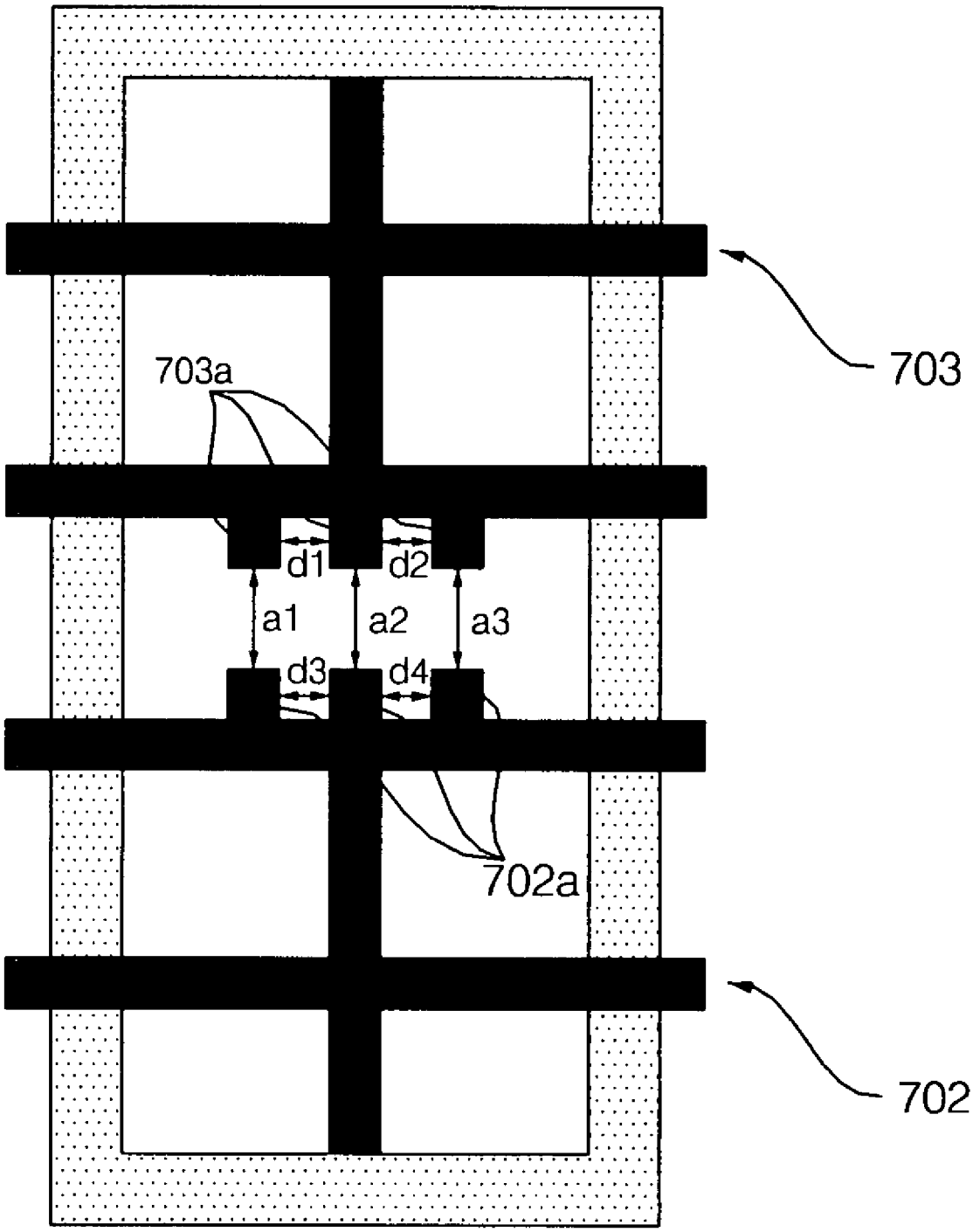
FIG. 10 is a cross-sectional view illustrating a fourth exemplary embodiment of an electrode structure of a plasma display panel according to the present invention.

FIG. 10 is a cross-sectional view illustrating a fourth exemplary embodiment of an electrode structure of a plasma display panel according to the present invention.

Descriptions described in FIG. 8 among electrode structures shown in FIG. 10 will be omitted.

As shown in FIG. 10, in the fourth embodiment of an electrode structure according to the present invention, three first projection electrodes 702*c* and 703*c* are formed in each of the sustain electrodes 702 and 703.

The first projection electrodes 702*c* and 703*c* are connected to the electrode lines 402*a* and 403*a* near the center of a discharge cell within one discharge cell and are projected in a center direction of a discharge cell. Preferably, any one of the first projection electrodes is formed in a mid point of the electrode lines and the remaining two first projection electrodes are formed to be symmetrical to each other based on a mid point of the electrode line. By forming three first projection electrodes in each of the sustain electrode, a discharge firing voltage becomes much lower than that of FIGS. 8 and 9 and a discharge speed becomes faster. Further, after a discharge is started, brightness further increases and a discharge is further uniformly diffused to entire discharge cells.

As described above, by increasing the number of the first projection electrode, an area of a sustain electrode increases from the center of a discharge cell, so that a discharge firing voltage is lowered and brightness increases. In the center of the discharge cell, the strongest discharge is generated and the brightest discharge light is emitted. That is, it is preferable that as the number of the first projection electrode increases, light emitted from the center of the discharge cell is intercepted and thus the emitted light is remarkably decreased and a structure of a sustain electrode is designed by selecting the best number in view of a discharge firing voltage and brightness efficiency at the same time.

Figure 11:
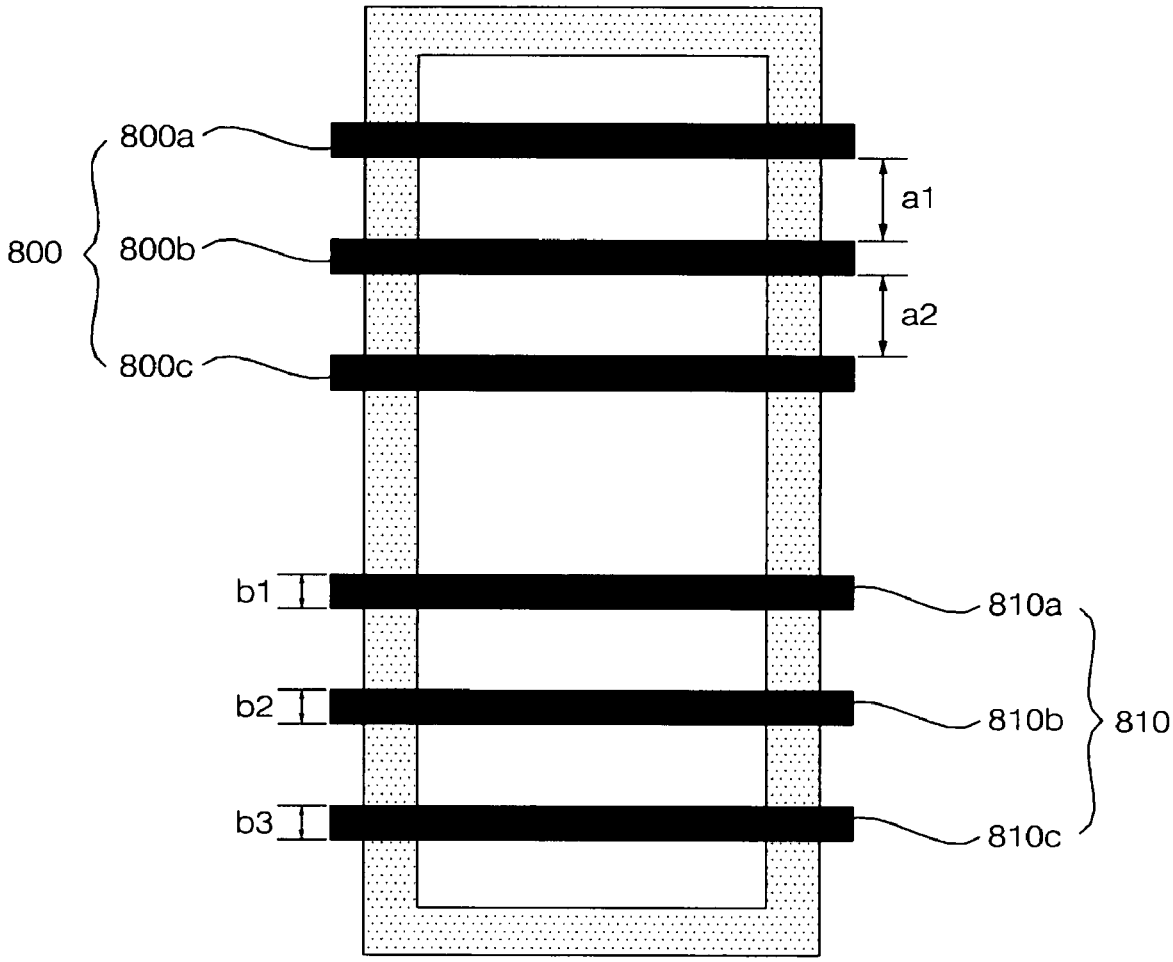
FIG. 11 is a cross-sectional view illustrating a fifth exemplary embodiment of an electrode structure of a plasma display panel according to the present invention.

FIG. 11 is a cross-sectional view illustrating a fifth exemplary embodiment of an electrode structure of a plasma display panel according to the present invention, where each of sustain electrodes 800 and 810 includes three electrode lines 800*a*, 800*b*, 800*c*, 810*a*, 810*b*, and 810*c* intersecting a discharge cell. The electrode lines intersect a discharge cell and are extended in one direction of a plasma display panel. The electrode lines have a narrow width in order to improve an aperture ratio and have a width of preferably 20 to 70 μm to improve an aperture ratio and smoothly generate a discharge.

Figure 12:
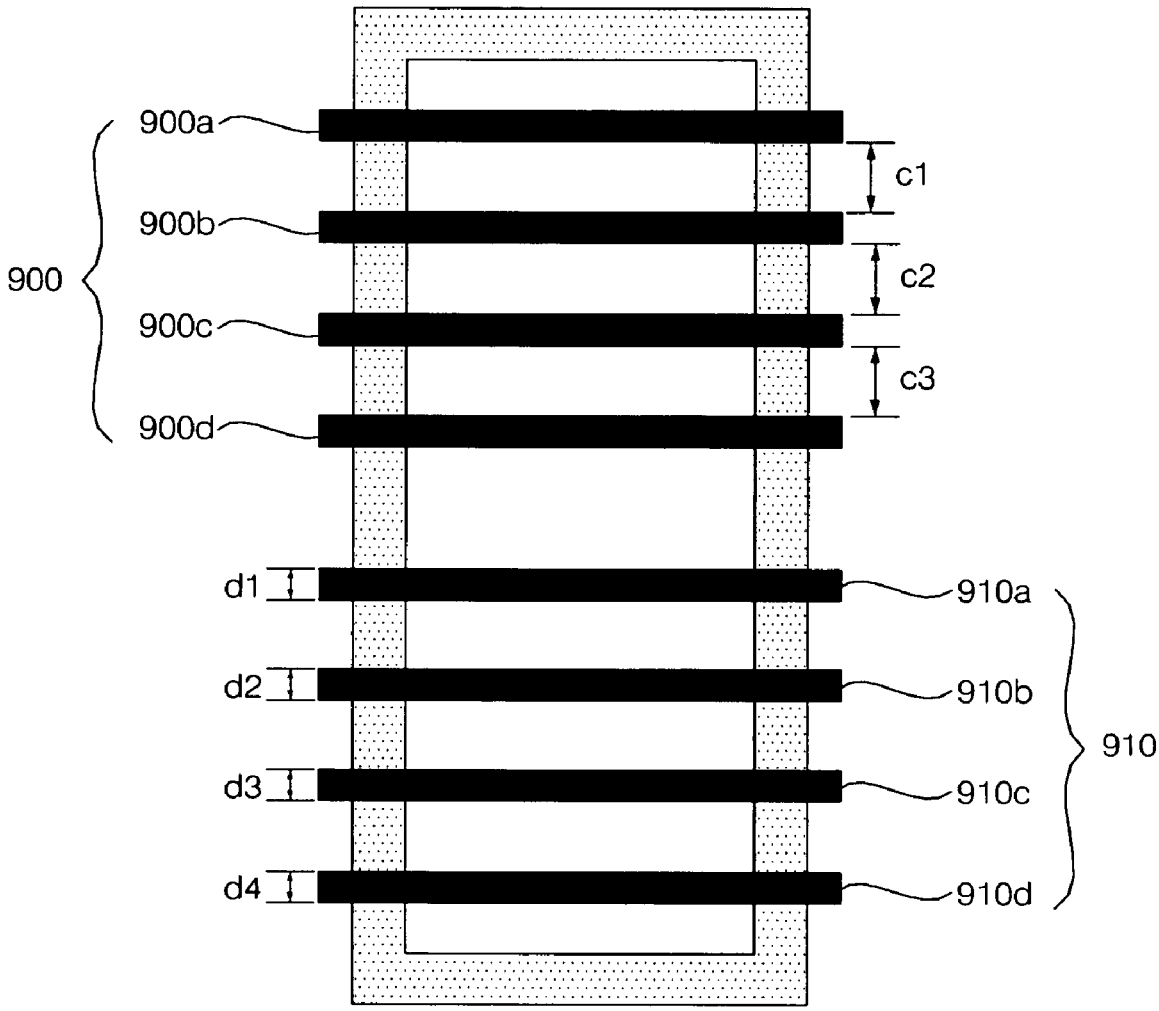
FIG. 12 is a cross-sectional view illustrating a sixth exemplary embodiment of an electrode structure of a plasma display panel according to the present invention.

FIG. 12 is a cross-sectional view illustrating a sixth exemplary embodiment of a electrode structure of a plasma display panel according to the present invention, where each of the sustain electrodes 900 and 910 includes four electrode lines 900*a*, 900*b*, 900*c*, 900*d*, 910*a*, 910*b*, 910*c*, and 910*d* intersecting a discharge cell. The electrode lines intersect a discharge cell and are extended in one direction of the plasma display panel. The electrode lines have a narrow width in order to improve an aperture ratio and have a width of preferably 20 to 70 μm to improve an aperture ratio and smoothly generate a discharge.

Intervals c1, c2, and c3 between four electrode lines for constituting each sustain electrode can be equal to or different from each other, and widths d1, d2, d3, and d4 of the electrode lines can be also equal to or different from each other.

Figure 13:
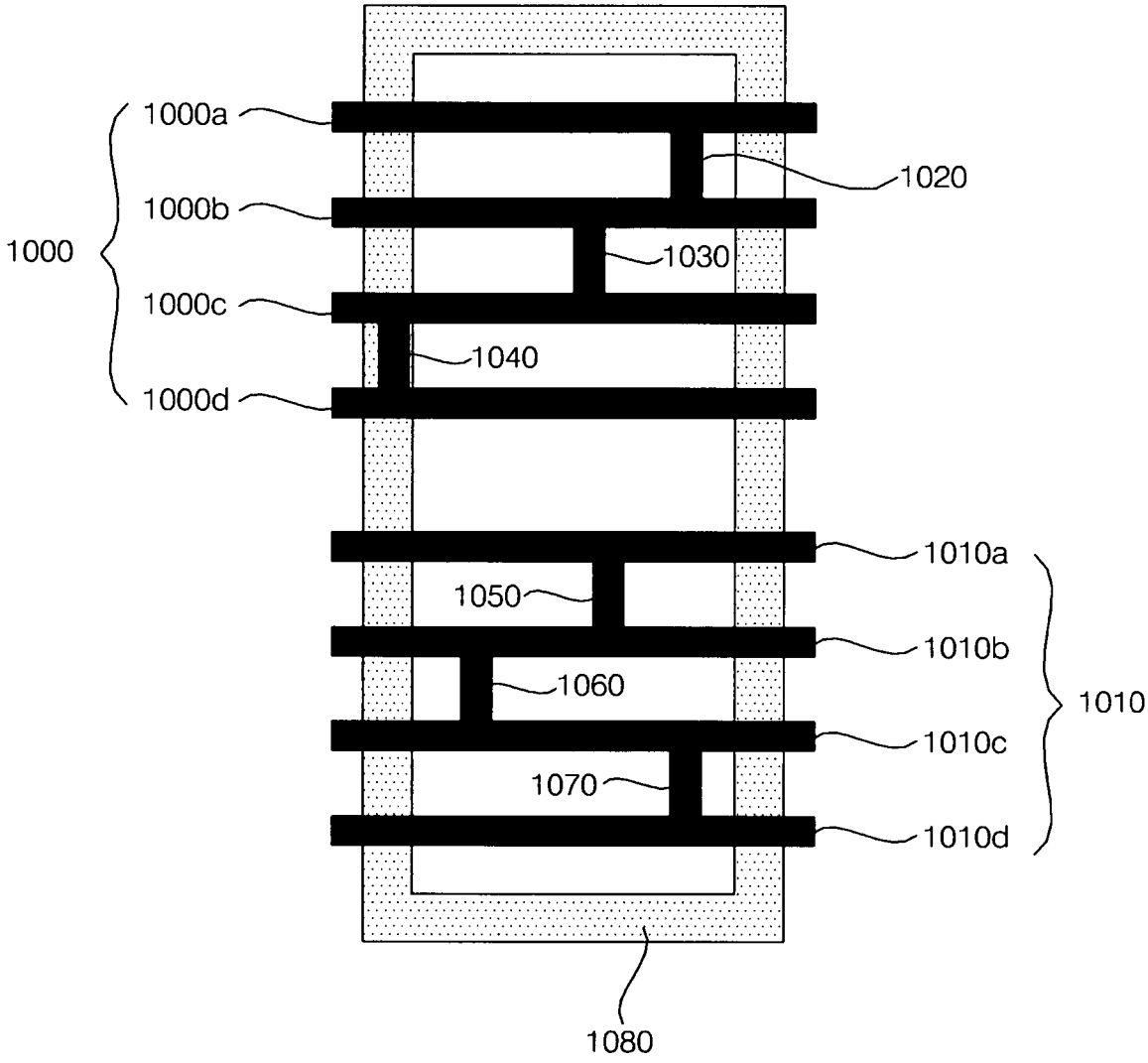
FIG. 13 is a cross-sectional view illustrating a seventh exemplary embodiment of an electrode structure of a plasma display panel according to the present invention.

FIG. 13 is a cross-sectional view illustrating a seventh exemplary embodiment of an electrode structure of a plasma display panel according to the present invention, where each of the sustain electrodes 1000 and 1010 includes four electrode lines 1000*a*, 1000*b*, 1000*c*, 1000*d*, 1010*a*, 1010*b*, 1010*c*, and 1010*d* intersecting a discharge cell. The electrode lines intersect a discharge cell and are extended in one direction of the plasma display panel.

Figure 14:
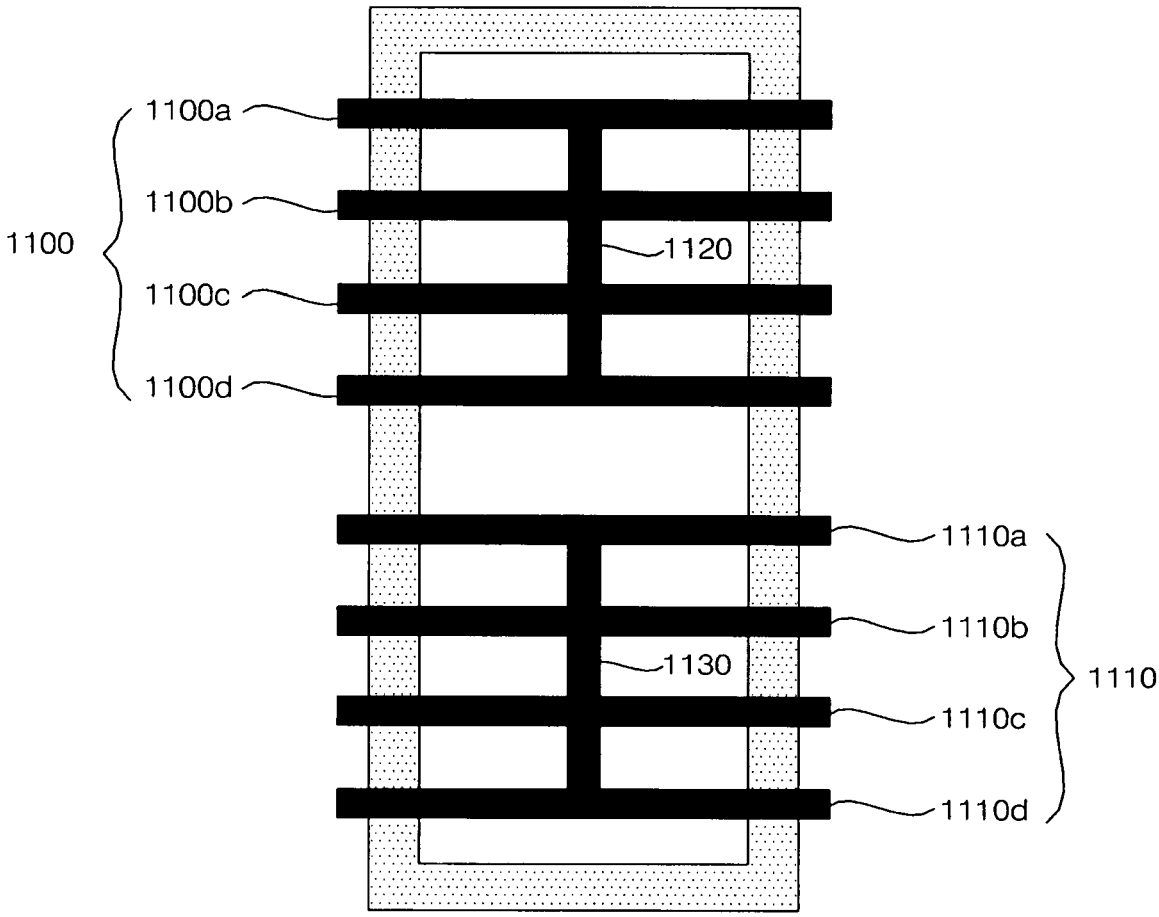
FIG. 14 is a cross-sectional view illustrating an eighth exemplary embodiment of an electrode structure of a plasma display panel according to the present invention.

Each of bridge electrodes 1020, 1030, 1040, 1050, 1060, and 1070 connects two electrode lines. The bridge electrodes 1020, 1030, 1040, 1050, 1060, and 1070 allow a started discharge to easily diffuse to an electrode line far from the center of a discharge cell. As shown in FIG. 14, positions of the bridge electrodes 1020, 1030, 1040, 1050, 1060, and 1070 may not correspond to each other and any one bridge electrode 1040 may be positioned on a barrier rib 1080.

FIG. 14 is a cross-sectional view illustrating an eighth exemplary embodiment of an electrode structure of a plasma display panel according to the present invention. Unlike a case shown in FIG. 14, bridge electrodes for connecting electrode lines are formed in the same position and thus one bridge electrode 1120 and 1130 for connecting four electrode lines 1100*a*, 1100*b*, 1100*c*, 1100*d*, 1110*a*, 1110*b*, 1110*c*, and 1110*d* to each of the sustain electrode 1100 and 1110 is formed.

Figure 15:
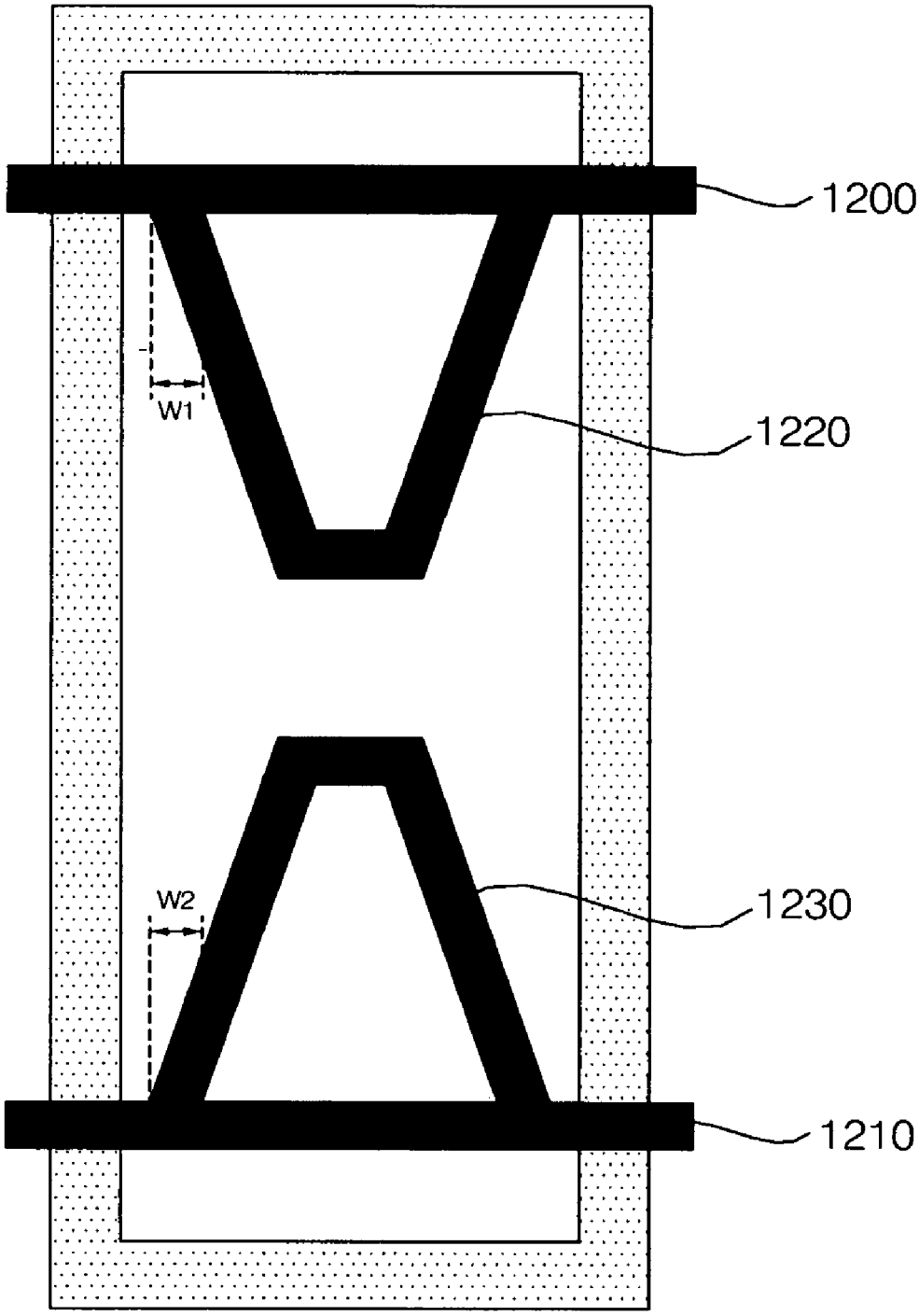
FIG. 15 is a cross-sectional view illustrating a ninth exemplary embodiment of an electrode structure of a plasma display panel according to the present invention.

FIG. 15 is a cross-sectional view illustrating a ninth exemplary embodiment of an electrode structure of a plasma display panel according to the present invention, where projection electrodes 1220 and 1230 including a closed loop are formed in each of electrode lines 1200 and 1210. An aperture ratio can be improved while lowering a discharge firing voltage through the projection electrodes 1220 and 1230 including a closed loop shown in FIG. 12. The projection electrode and the closed loop can be variously deformed.

Figure 16:
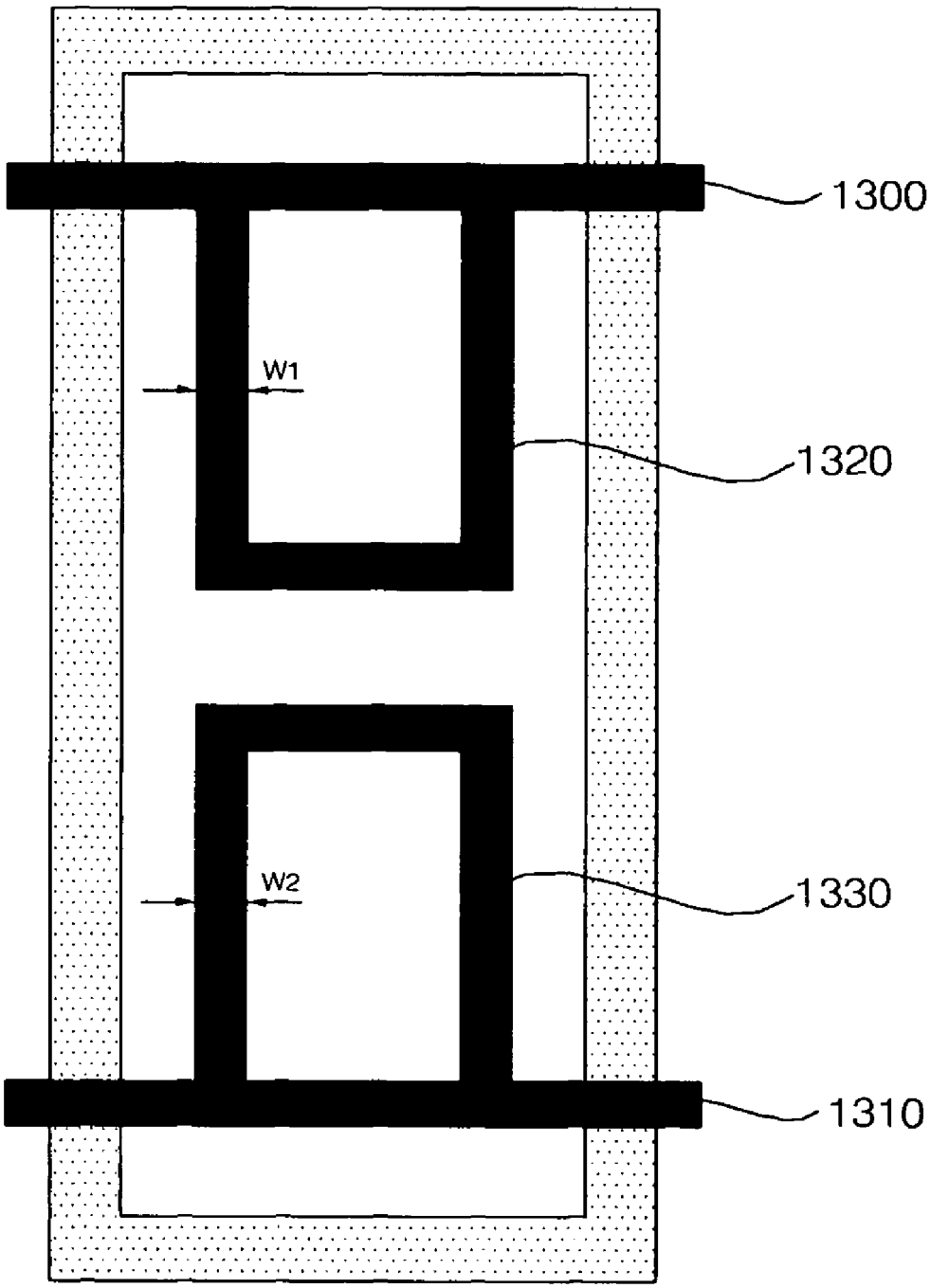
FIG. 16 is a cross-sectional view illustrating a tenth exemplary embodiment of an electrode structure of a plasma display panel according to the present invention.

FIG. 16 is a cross-sectional view illustrating a tenth exemplary embodiment of an electrode structure of a plasma display panel according to the present invention, where projection electrodes 1320 and 1330 including a closed loop having a quadrangular shape are formed in each of the electrode lines 1300 and 1310

Figure 17A:
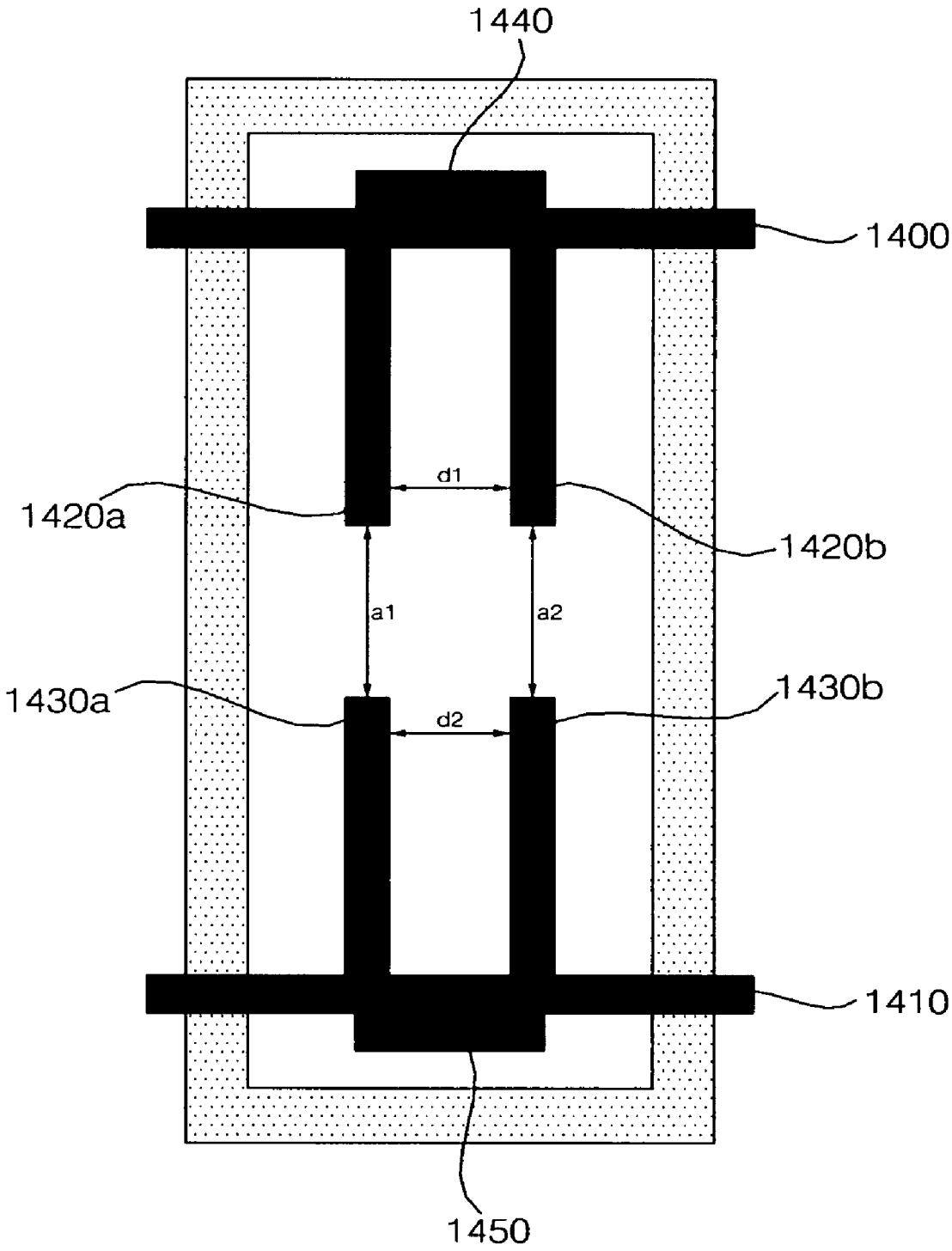
FIGS. 17*a* and 17*b* are cross-sectional views illustrating an eleventh exemplary embodiment of an electrode structure of a plasma display panel according to the present invention.
Figure 17B:
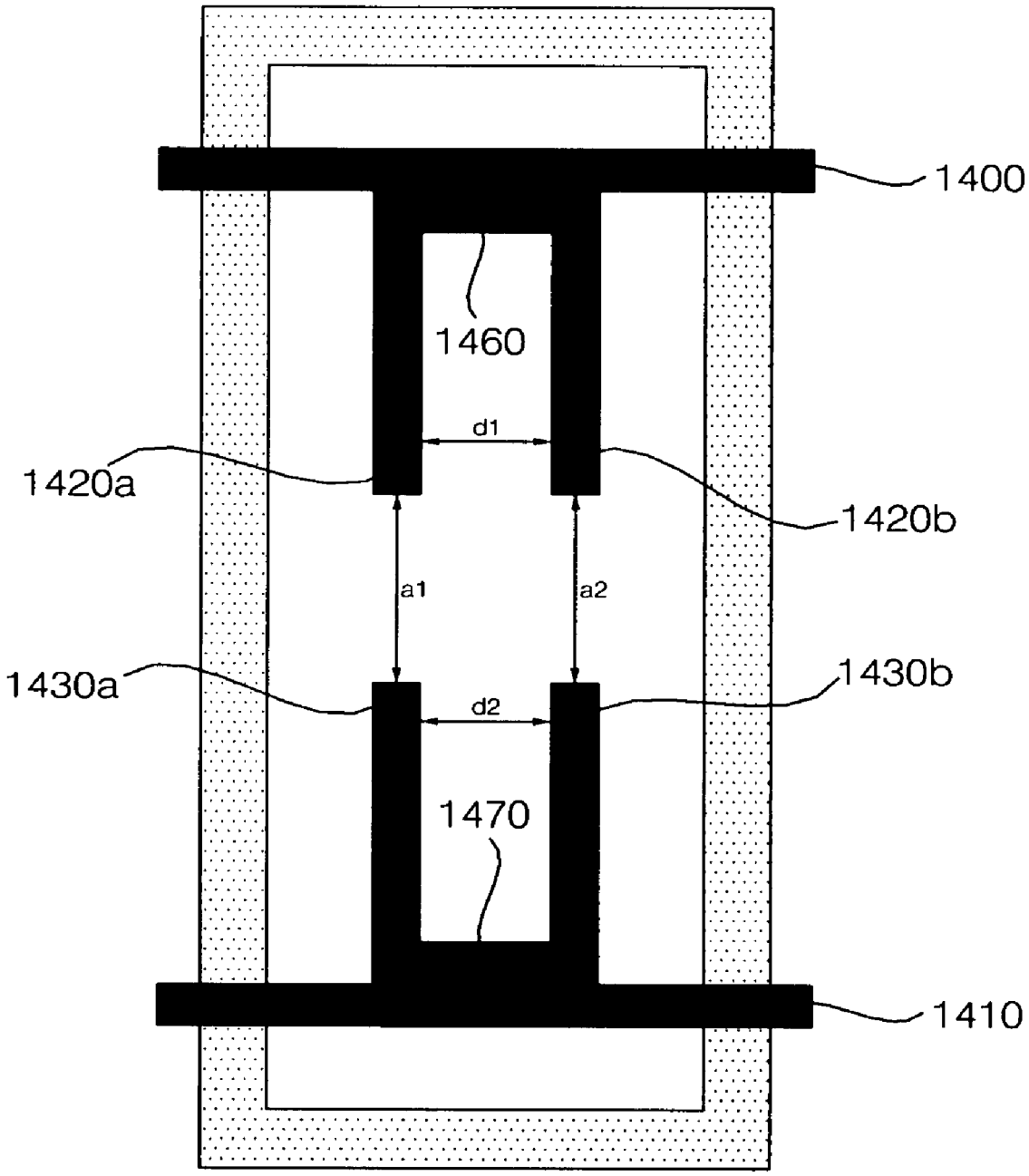

FIGS. 17*a* and 17*b* are cross-sectional views illustrating an eleventh exemplary embodiment of an electrode structure of a plasma display panel according to the present invention, where first projection electrodes 1420*a*, 1420*b*, 1430*a*, and 1430*b* projected in the center direction of the discharge cell and second projection electrodes 1440, 1450, 1460, and 1470 projected in a center direction or an opposite direction of the discharge cell are formed in each of electrode lines 1400 and 1410.

As shown in FIG. 17*a*, it is preferable that two first projection electrodes 1420*a*, 1420*b*, 1430*a*, and 1430*b* projected in a center direction of a discharge cell are formed in each of the electrode lines 1400 and 1410, and one second projection electrode 1440 and 1450 projected in an opposite direction of a center direction of the discharge cell is formed. Otherwise, as shown in FIG. 17*b*, the second projection electrode 1460 and 1470 may be projected in a center direction of the discharge cell.

In a panel provided in a plasma display apparatus according to the present invention having the described configuration, a production cost of a plasma display panel can be reduced by removing a transparent electrode consisting of ITO, a discharge firing voltage can be lowered and discharge diffusion efficiency can be improved within a discharge cell by forming projection electrodes projected in a center direction or an opposite direction of a discharge cell from a scan electrode or sustain electrode line. Further, a discharge can be generated between a floating electrode and a sustain electrode by forming a floating electrode on a black matrix formed to be overlapped in a barrier rib, whereby an initial discharge firing voltage of a sustain discharge between sustain electrodes can be lowered.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

an upper substrate;

at least one first electrode and at least one second electrode adjacent the upper substrate;

a lower substrate arranged to be opposite to the upper substrate;

at least one third electrode and barrier ribs formed adjacent in the lower substrate;

a black matrix adjacent the upper substrate and disposed at a location which causes the black matrix to overlap at least one of the barrier ribs; and a fourth electrode adjacent the black matrix and crossing the third electrode, wherein the first electrode, second electrode, and fourth electrode are formed in one layer consisting of only a bus electrode.

2. The plasma display apparatus of claim 1, further comprising a dielectric layer adjacent the upper substrate, wherein at least one of the first electrode or second electrode has a color darker than the dielectric layer.

3. The plasma display apparatus of claim 1, wherein the fourth electrode is floated or grounded.

4. The plasma display apparatus of claim 1, wherein the fourth electrode overlaps at least one of the barrier ribs.

5. The plasma display apparatus of claim 1, wherein the fourth electrode is in contact with the black matrix.

6. The plasma display apparatus of claim 1, wherein a width of the fourth electrode is less than a width of the black matrix.

7. The plasma display apparatus of claim 1, wherein a width of the fourth electrode is less by 10 μm to 20 μm than a width of the black matrix.

8. The plasma display apparatus of claim 1, wherein a distance between any one of the first electrode or the second electrode and the fourth electrode is 40 μm to 60 μm.

9. The plasma display apparatus of claim 1, wherein the black matrix is formed between any one of the plurality of first and second electrodes and the upper substrate.

10. The plasma display apparatus of claim 1, wherein the fourth electrode is formed to have at least two electrode lines.

11. The plasma display apparatus of claim 1, wherein a positive voltage and a negative voltage is alternately applied to the first and second electrodes.

12. The plasma display apparatus of claim 1, wherein a negative voltage is supplied to the fourth electrode while a positive voltage is supplied to any one of the first and second electrodes.

13. The plasma display apparatus of claim 1, wherein a positive voltage is supplied to the fourth electrode while a negative voltage is supplied to any one of the first or second electrodes.

14. The plasma display apparatus of claim 1, wherein before a reset period for initializing a discharge cell, a first voltage is supplied to any one of the first or second electrodes and a second voltage having a polarity different from a polarity of the first voltage is supplied to the fourth electrode while the first voltage is supplied.

15. The plasma display apparatus of claim 1, wherein the first, second and fourth electrodes are located in a same plane with said one layer.

16. The plasma display apparatus of claim 15, wherein the first, second, and fourth electrodes are made from an opaque conductive material.

17. The plasma display apparatus of claim 15, wherein the first, second, and fourth electrodes are made from a material different from indium-tin-oxide (ITO).

18. The plasma display apparatus of claim 15, wherein the fourth electrode is located between the first and second electrodes.

19. The plasma display apparatus of claim 15, wherein:

the first electrode is a scan electrode, the fourth electrode is located between the second electrode and another scan electrode, no intervening electrodes are located between the fourth electrode and the scan electrode and between the fourth electrode and said another scan electrode, and the first electrode, second electrode, fourth electrode, scan electrode, said another scan electrode are all formed in a same plane within said one layer.

20. A plasma display apparatus comprising:

an upper substrate;

at least one first electrode and at least one second electrode adjacent the upper substrate;

a lower substrate arranged to be opposite to the upper substrate;

at least one third electrode and barrier ribs adjacent the lower substrate;

a black matrix adjacent the upper substrate and disposed at a location which causes the black matrix to overlap at least one of the barrier ribs;

a fourth electrode adjacent the black matrix and crossing the third electrode;

a first line formed to cross the third electrode; and a second line protruded from the first line, wherein the first electrode, second electrode, and fourth electrode are formed in one layer consisting of only a bus electrode.

21. The plasma display apparatus of claim 20, wherein a width of the fourth electrode is less by 10 μm to 20 μm than a width of the black matrix.

22. The plasma display apparatus of claim 20, wherein a distance between any one of the first or second electrodes and the fourth electrode is 40 μm to 60 μm.

23. The plasma display apparatus of claim 20, wherein a positive voltage and a negative voltage is alternately applied to the first and second electrodes.

24. The plasma display apparatus of claim 20, wherein a negative voltage is supplied to the fourth electrode while a positive voltage is supplied to any one of the first or second electrodes.

25. The plasma display apparatus of claim 20, wherein a positive voltage is supplied to the fourth electrode while a negative voltage is supplied to any one of the first or second electrodes.

* * * * *